US007150276B1

(12) United States Patent
Rice

(10) Patent No.: US 7,150,276 B1
(45) Date of Patent: Dec. 19, 2006

(54) PNEUMATIC PAINTBALL MARKER

(76) Inventor: Jack V. Rice, 9006 Wimbley Ct., Elk Grove, CA (US) 95624

( * ) Notice: Subject to any disclaimer, the term of this patent is extended or adjusted under 35 U.S.C. 154(b) by 160 days.

(21) Appl. No.: 10/887,742

(22) Filed: Jul. 8, 2004

Related U.S. Application Data

(60) Provisional application No. 60/485,805, filed on Jul. 9, 2003.

(51) Int. Cl.
*F41B 11/32* (2006.01)

(52) U.S. Cl. ..... 124/73; 124/77

(58) Field of Classification Search ..... 124/41.1, 124/56, 49, 71–77
See application file for complete search history.

(56) References Cited

U.S. PATENT DOCUMENTS 5,462,042 A 10/1995 Greenwell
5,497,758 A 3/1996 Dobbins
5,503,137 A 4/1996 Fusco
5,520,171 A * 5/1996 David ..... 124/51.1
5,673,679 A 10/1997 Walters
5,769,066 A 6/1998 Schneider
6,276,353 B1 * 8/2001 Briggs et al. ..... 124/71
6,343,599 B1 2/2002 Perrone
6,371,099 B1 4/2002 Lee
6,520,171 B1 2/2003 Reible
6,739,323 B1 * 5/2004 Tippmann, Jr. ..... 124/51.1
6,802,306 B1 * 10/2004 Rice ..... 124/74
2002/0096164 A1 7/2002 Perrone
2002/0104524 A1 * 8/2002 Reible ..... 124/73
2003/0075161 A1 4/2003 Fujimoto

OTHER PUBLICATIONS

Insight Component Engineering; The Epic; "http://icepaintball.com/" internet website; Apr. 3, 2001.

* cited by examiner

*Primary Examiner*—Michael J. Carone
*Assistant Examiner*—Stewart Knox
(74) *Attorney, Agent, or Firm*—Heisler & Associates

(57) ABSTRACT

Paintball marker including a firing chamber having a barrel coupled to one end and a removable back plug coupled to an opposing end, a door surmounting a chamber loading hole disposed between back plug and barrel; a cam coupled to door; an actuator coupled to door cam; a pin valve interposed in a first gas path between a gas source and a passage leading to the chamber, and a trigger coupled to a second gas path between the gas source and actuator for opening the second gas path for actuating the actuator such that the door cam transforms motion of the actuator into pivoting motion of the door from an open position such that a paintball is loaded into the chamber to a closed position and then continuing to actuate the actuator to coact with the pin valve for opening the first gas path for firing the paintball.

23 Claims, 12 Drawing Sheets

PNEUMATIC PAINTBALL MARKER

CROSS-REFERENCE TO RELATED APPLICATIONS

This application claims benefit under Title 35, United States Code § 119(e) of U.S. Provisional Application No. 60/485,805 filed on Jul. 9, 2003.

This application incorporates herein by reference the entire contents of pending U.S. patent application Ser. No. 10/033,161 filed on Oct. 26, 2001 and for which a notice of allowance was provided on Jun. 29, 2004.

FIELD OF THE INVENTION

This invention relates generally to paintball markers for firing paintballs with sufficient velocity to explode the paintballs against a target and, in particular, to pneumatic paintball markers which are capable of rapidly firing a large number of paintball rounds.

BACKGROUND OF THE INVENTION

Paintball markers are popular for firing a spherical ball loaded with a marking dye designed to rupture and mark a target on contact. Typical markers have an appearance similar to a handgun or small rifle but are typically fired by compressed air rather than an explosive charge. Compressed air (or other compressed gases) is stored within the marker with the compressed air firing the paintball out of a firing chamber.

Rapid-fire operation of the paintball marker has recently become particularly desirable and has resulted in advances in paintball marker accessories including the force-feeding of paintballs into the markers to obtain ever-faster rates of fire.

Generally the main distinctions between paintball markers is the choices between the usage of one, an impact opening pin valve vs. a spool valve, also referred to as a dump valve and two, an open bolt vs. a closed bolt.

The distinction between the impact opening pin valve vs. spool valve markers is that the former uses an impact opening pin valve for momentary escapement of a continuous supply of air while, the latter spool valve, stores air in a separate chamber and dumps a predetermined amount of air.

With respect to the open bolt vs. closed bolt terminology it should be noted that a majority of markers employ the combination of a bolt and an impact opening pin valve, it is noteworthy that the more correct term would be "open chamber" vs. "closed chamber". Hence, the distinction between the open and closed refers to whether or not the chamber is indeed open to the supply of paintballs when the marker is in the rest position.

The desired effects of those making choices in engineering, are listed as guidelines to design:

One desired effect is speed. Semi-automatic markers should cycle as quickly as possible. A benchmark would be firing in excess of 20 balls per second for highest priced markers. Entry-level markers have a benchmark in the 8 to 10 balls per second range. This can be improved to 12 to 14 balls per second with the use of an optional electronically controlled trigger mechanism. A separate stock class or pump marker is available that operate at slower speeds that is generally used exclusively from semiautomatic markers. Note: stated speed is measures in bursts over a chronograph.

Measurement being taken as a maximum of several balls in less than a whole second, not as a full second or more than one second.

Another desired effect is air efficiency. Good seals and an impact opening pin valve being sufficient. Spool or dump valves being less efficient but acceptable.

A further desired effect is accuracy. The paintball's delivery into the barrel by the bolt, being the most contested factor in accuracy. Engineering choices include: open bolt or closed bolt; method of detaining the ball in place; speed and pressure of bolt transitioning ball into barrel and its effect on ball with subsequent ball deflection. Additionally, turbulence in the firing chamber should be kept to a minimum. An increase in turbulence has been acknowledged to cause a decrease in flight accuracy.

Another further desired effect is ease of cleaning in the event of ball rupture in the marker housing. Removing the bolt and cleaning the marker with a swab from back to front usually accomplish cleaning.

Desirable features sometime conflict, such as, lightweight vs. rugged and a smaller size vs. accuracy. Additionally, there are liabilities to design inherent in the dump valve or spool valve markers listed above such as:

One, its difficulty in cleaning in the event of a broken paintball in the marker housing. It is nearly a universal practice for dump valve type markers to locate compressed gas, stored for use in firing the next paintball, in the area behind and directly in line with the firing chamber. Therefore dump valve markers can only be cleaned from the front.

Two, its lower gas efficiency. This is sometimes overcome by use of higher pressure air to fire the ball. While it is arguable in the engineering community if said higher pressure is undesirable, it is generally considered within the playing community to be highly desirable to have low firing pressure.

Three, its high impact speed of chambering object caused to transition paintball into the barrel. The object is powered by a piston itself powered by the air that has been released to fire the paintball.

It is deemed, by those selecting the dump valve markers as their choice in engineering, that the inherent liabilities to design are overcome by the combination of entry-level price and increased speed possible with the dump valve type markers.

Similarly, there are liabilities to design inherent to boltless markers:

One: Paintball should be transitioned into the barrel before the impact of the air used to propel out of the barrel. Transitioning paintball with air used to propel paintball results in increased paintball breakage, increased turbulence and decreased air efficiency.

Two: Method of sealing the firing chamber. Chamber should be sealed as completely as possible as loss of seal decreases air efficiency.

Three: Impact of door, or other sealing mechanism, on the paintball to be loaded next. The bolts being substantially the same size as the paintballs the bolts makes negligible contact with the paintball. However with the use of a door sealing over the paintballs, the entire width of the door impacts paintball and occupies the space previously taken by the paintball.

Four: Possible lower speed of operation than found elsewhere in the art.

Five: Increased turbulence of compressed gas acting upon paintball. Increased turbulence sometimes caused by air travel through the dissimilar shape of firing chamber when compared to cylindrical barrel.

Background of Boltless Markers: Some examples of open chamber dump valve type markers which have had some commercial success include those manufactured by Air Star and sold under the name NOVA and the name SUPER NOVA. Although a second-generation marker, manufactured by War Machine Incorporated and sold under the name WAR MACHINE ASSAULT 80 has replaced them. These markers employ a barrel that retracts rearward and over paintball, sealing firing camber. This retracting barrel transitions ball into the barrel before air impacted paintball. These markers provide good sealing and loading but, have inherent liabilities a slower speed of operation than is possible in the art and a decrease in air efficiency.

Some further attempts at a commercial application of a boltless rotary seal include markers sold under the respective names the PHOENIX and the PHANTOM REVOLUTION. The PHANTOM REVOLUTION is manufactured by Component Concepts Incorporated. These two markers are closed chamber markers. Both sealed the firing chamber by the use of a revolving seal, the usage being common in firearms, specifically in pistols. Rotating on an axis, parallel to firing chamber and barrel, separated chambers intersect and align with firing chamber, momentarily sealing said rotating chamber and said firing chamber as one unit. Limitation of these markers include: Paintball not being transitioned into barrel, lower speed of operation and less gas efficient.

A further example of a boltless design is illustrated in U.S. Pat. No. 6,520,171 issued on Feb. 18, 2003 to Reibel and is embodied in a marker being manufactured by Insight Component Engineering under the name EPIC as there current attempt at commercial success using a boltless design. This marker chooses a dump valve and a closed firing chamber. As noted, a nearly universal feature of dump valve markers, a storage chamber is located behind and inline with the firing chamber. In contrast, the Insight Component Engineering marker sold under the name EPIC uses the energy of compressed gas within a chamber to power a piston coupled to a door. In essence when storage chamber is empty a spring acts upon the door opening it and allowing a paintball into the firing chamber. When the compressed air storage is charged, the rest position, the compressed air pushes the piston forward, piston itself being slideably supported with a cylindrical bore. Piston's forward movement causing forward movement of the door coupled thereto for sliding over paintball and seal firing chamber.

Additionally one very commercially successful marker is manufactured by Dye Precision Incorporated and sold under the name MATRIX. This marker evolved from a boltless marker, into a morphed spindle/bolt design. Specifically, a prototype of the very commercially successful MATRIX previously used a door that lifted up and down. The MATRIX prototype used a dump valve and an open chamber. MATRIX sealed firing chamber somewhat similar to the PHOENIX and the REVOLUTION, except instead of rotating into position with a ball, the MATRIX prototype rotated a door open and closed for each cycling. Inherent limitations including: air used to propel paintball was used to transition paintball, lower speed of operation, loss of air efficiency and most notably the impact of door on the paintball next to be loaded. The unique principle of the MATRIX is the use of a larger spindle to direct air first into a storage chamber and then into the firing chamber, the spindle itself shuttling back and forth in said chamber between the firing chamber and compressed gas storage area. Said limiting factors lead MATRIX to abandon use of a door, instead using a protrusion of the air-directing spindle. The extension of the spindle itself performing the function of, and having the appearance of, an otherwise free floating bolt.

The use of a seal sliding over the ball, omitting a bolt to transition the paintball into the barrel, is an inexplicable one in the marker manufactured by Insight Component Engineering and sold under the name EPIC. The marker arguably closet to this marker is a very commercially successful marker manufactured by Air Gun Design and sold under the name AUTOMAG. Both of these markers are dump valve markers that use the compressed gas stored behind the firing chamber to act upon a piston, causing the sealing of the firing chamber. The marker manufactured by Air Gun Design and sold under the name AUTOMAG has an open chamber choosing to have the stored compressed gas act on their piston during the firing cycle, while the marker manufactured by Insight Component Engineering and sold under the name EPIC is closed chamber choosing instead to have the air act on the piston while stored.

More specifically, initiation of firing sequence in the marker manufactured by Air Gun Design and sold under the name AUTOMAG causes air escapement from said storage chamber. The air acts on ram moving it forward. Ram being located between the stored air and said firing chamber in a cylindrical bore. The ram additionally having a protrusion extending from it. The extension of the ram itself performing the function of, and having the appearance of, an otherwise free floating bolt (note similarity to the marker manufactured by Dye Precision Incorporated and sold under the name MATRIX which was introduced years after the marker manufactured by Air Gun Design and sold under the name AUTOMAG). The marker manufactured by Insight Component Engineering and sold under the name EPIC chooses to have the air act on the piston initially, and an extension of their piston, a rod and a door mated to the rod, then acts as independently from the paintball as possible. Chamber sealed when door slides over the paintball.

The marker manufactured by Insight Component Engineering and sold under the name EPIC has engineering choices leading to the inherent limitations of: transitioning the paintball into barrel by the use of the air that used to propel the paintball out of the barrel, lower speed of operation than possible elsewhere in the art, decreased air efficiencies (due to reduced sealing efficiencies), increased turbulence of compressed gas acting upon paintball caused by air travel through dissimilar shape of firing chamber when compared to cylindrical barrel and impact of door on the paintball next to be loaded. Acceptance of said limitations is difficult to understand when AUTOMAG and MATRIX employ the use of a protrusion from piston that performs the function of a bolt in similar circumstances.

While advancements have been made in the art to achieve rapid-fire operation, problems with such rapid-fire paintball markers persist. These problems include excessive length of the paintball marker, excessive pressure on paintball while transitioning into barrel, excessive turbulence in firing chamber, excessive jamming of the mechanisms that load the paintball into the firing chamber and difficulty of required cleaning inside marker housing after paintball rupture. Also excessive complexity of prior markers leads to excessive cost and more difficult maintenance.

Accordingly, a need exists for a rapid-fire paintball marker with a loading and firing apparatus which addresses these deficiencies in the prior art.

SUMMARY OF THE INVENTION

The present invention is distinguished over the known prior art in a multiplicity of ways. For one thing, an embodiment of the invention provides a pneumatic paintball marker comprised offset or nonparallel sealing such that a desirable reduction in size and weight and is accomplished by the unique use of a cam and a pivoting door arrangement to affect upper firing chamber sealing and the use of a removable back plug which seals a rear of the firing chamber while smoothing the transition of air into firing chamber and, when removed, allows full access for easy cleaning of the marker. Particularly, and in one embodiment of the invention, the pivoting door and removable back plug allow a barrel to be located decidedly rear in the marker allowing for a dramatic reduction in the size of the marker and a relative reduction in weight from prior art, approximately half the body length previously possible in semiautomatic markers.

In one embodiment of the invention, the pneumatic paintball marker is comprised of a firing chamber having a barrel coupled to one end and a removable back plug coupled to an opposing end, a door surmounting a firing chamber loading hole disposed between the back plug and the barrel; a cam coupled to the door; an actuator coupled to the door cam; a pin valve interposed in a first gas path between a source of compressed gas and a passage leading to the firing chamber, and a trigger coupled to a second gas path between the source of compressed gas and the actuator for opening the second gas path for actuating the actuator such that the door cam transforms motion of the actuator into pivoting motion of the door from an open position such that a paintball is loaded into the firing chamber to a closed position and then continuing to actuate the actuator to coact with the pin valve for opening the first gas path for firing the paintball.

Additionally, an embodiment of the invention provides a pneumatic paintball marker comprised of an impact-opening pin valve such as a hammer actuated pin valve. In one embodiment of the invention, the impact-opening pin valve or hammer actuated pin valve can have an escape hole of an elongated or oval shape or multiple escape holes together each having an elongated or oval shape for evenly distributing air into the firing chamber for a more even pressure on the paintball as it is fired. This even pressure allows for more consistent flight trajectory and more accurate shots. One embodiment of the invention also provides a pneumatic paintball marker comprised of a low pressure regulator having a regulator pin extending backwards from a seal into a blind bore disposed within housing for allowing more exact alignment of the regulator pin and therefore more exact seating of the pin on a valve seal. This improved alignment allows for a more exact and consistent regulation of the air than has been possible with the prior art.

Furthermore, and in one embodiment of the invention, the pneumatic paintball marker includes electronic activation of the paintball marker by means of: at least one solenoid, a timing control circuit, a trigger, a switch or sensor, and a battery or other power source. The electronic firing of the marker by means at least one solenoid, the timing control circuit, the trigger, the switch or sensor, and the battery or other power source allows for more exact timing of firing thereby less ball breaks in the firing chamber and faster operation of the marker thereby providing faster more controlled firing of the marker with less ball breakage.

Moreover, and in one embodiment of the invention, a magnetic resistor may be built into the ram for impeding initial ram motion for allowing air pressure build up. For example, a magnet may be built into the ram for initially resisting ram movement into the closed and firing position. This initial resistance allowing for the build up of pressure before the start of the closing and firing stroke, this build up and resistance of pressure provides the benefit of using a lower pressure to operate the paintball marker. Additionally, and in an embodiment of the invention, a sensor using break beam or reflective may be used for allowing the timing control circuit to adjust for the presence or absence of paintball within the loading chamber.

More particularly, and in one embodiment of the invention, the pneumatic paintball marker is comprised of a housing having a hollow open ended firing chamber extending there through and having a first open end operatively coupled to a barrel and a second open end closed by a removable back plug for allowing easy cleaning of the marker. The pneumatic paintball marker further includes a paintball-loading hole in a side wall thereof at a location between the back plug and the barrel and includes a pivoting door surmounting the firing chamber and pivotally coupled to the housing for providing access to the paintball-loading hole when the door is pivoted to an open position and for sealing the firing chamber when the door is pivoted to a closed position. Additionally, and in one embodiment of the invention, the pneumatic paintball marker further includes a cam operatively coupled to the door and a control means including a linear actuator operatively coupled to the door cam such that the door cam transforms a linear motion of the linear actuator into a rotational motion of the door for pivoting the door from the open to closed position and from the closed to open position. Furthermore, and in one embodiment of the invention, the pneumatic paintball marker is comprised of a pin valve interposed between a source of compressed gas and a bore leading to the firing chamber and located adjacent the linear actuator for controlling a gas path between the source of compressed gas and the firing chamber. Moreover, and in one embodiment of the invention, the pneumatic paintball marker is further comprised of a selectively openable gas path between the source of compressed gas and the linear actuator of the controls means, and a trigger means operatively coupled to the control means for opening the selectively openable gas path between the source of compressed gas and the linear actuator for moving the linear actuator from a forward to a backward position such that the cam means transforms linear motion of the linear actuator into rotational motion of the door for pivoting the door from the open position such that a paintball is loaded into the firing chamber to a closed position for sealing the firing chamber and blocking passage of paintballs therein and then continuing to move the linear actuator backward to a position of impact with the pin valve for opening the gas path between the source of compressed gas and the firing chamber for firing the paintball through and out the barrel in an opposite direction of movement of the linear actuator when the trigger means is actuated.

Accordingly, having thus summarized the invention, it should be apparent that numerous modifications and adaptations may be resorted to without departing from the scope and fair meaning of the present invention as set forth hereinbelow by the claims.

DESCRIPTION OF THE PREFERRED EMBODIMENT

Figure 1:
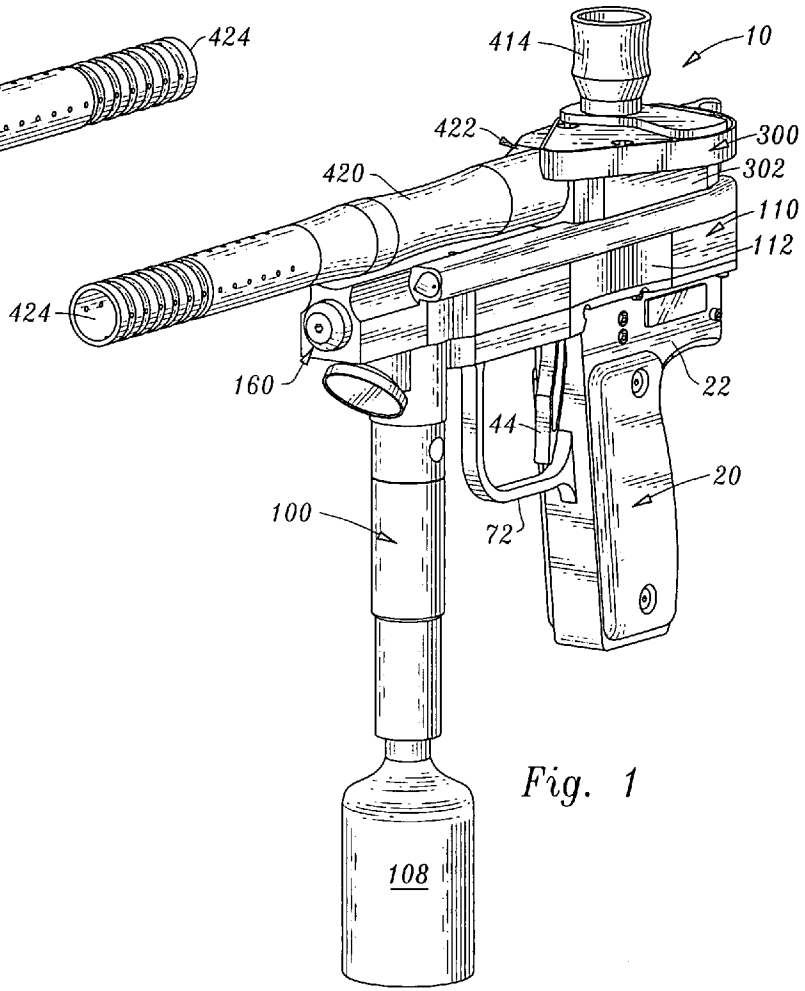
FIG. 1 is a perspective view from a front and side of a paintball marker of this invention.

Considering the drawings, wherein like reference numerals denote like parts throughout the various drawing figures, reference numeral 10 is directed to a pneumatic paintball marker.

In its essence, and referring to the drawings, one embodiment of the invention provides a paintball marker 10 comprised of a hollow open ended firing chamber 322 having a barrel 420 coupled to one end 324 and a removable back plug 334 coupled to an opposing end 326, a door 360 surmounting a paintball loading hole 328 disposed between the back plug 334 and the barrel 420; a cam 370 coupled to the door 360; an actuator 180 coupled to the door cam 370; a pin valve 230 interposed in a first gas path between a source of compressed gas 108 and a passage 332 leading to the firing chamber 322, and a trigger 44 operatively coupled to a second gas path between the source of compressed gas 108 and the actuator 180 for opening the second gas path for actuating the actuator 180 such that the door cam 370 transforms linear motion of the actuator 180 into pivoting motion of the door 360 about double ended arrow A (FIG. 30) from an open position such that a paintball is loaded into the firing chamber to a closed position and then transforms linear motion of the actuator 180 into actuation of the pin valve 248 for opening the first gas path for firing the paintball.

Figure 2:
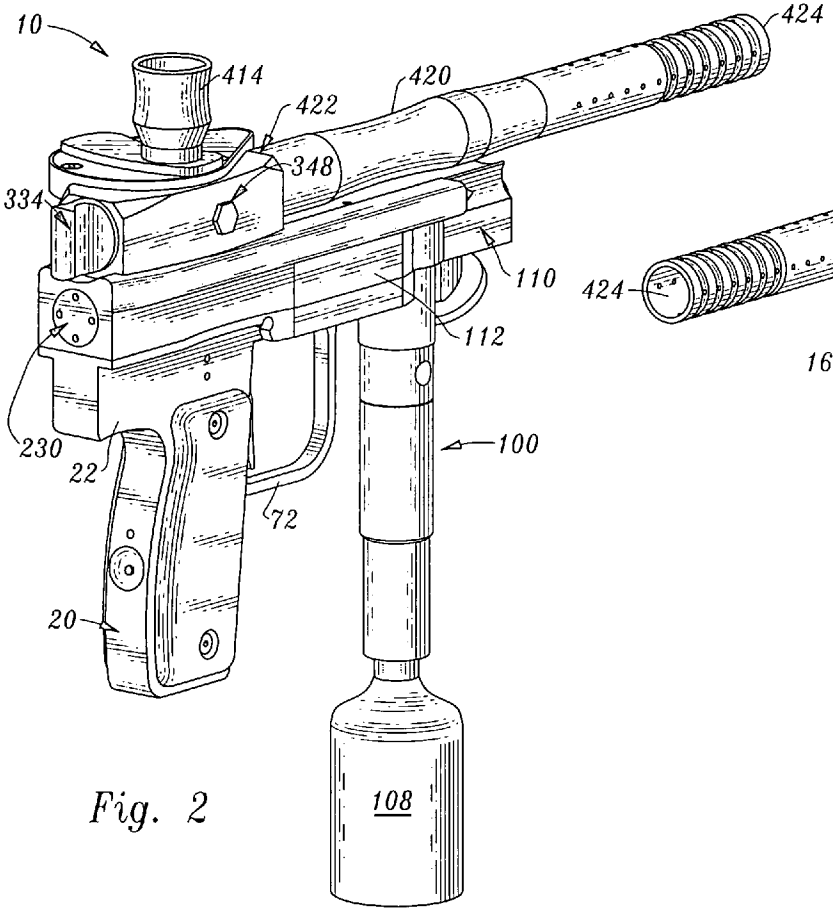
FIG. 2 is a perspective view from a back and side of the paintball marker.
Figure 3:
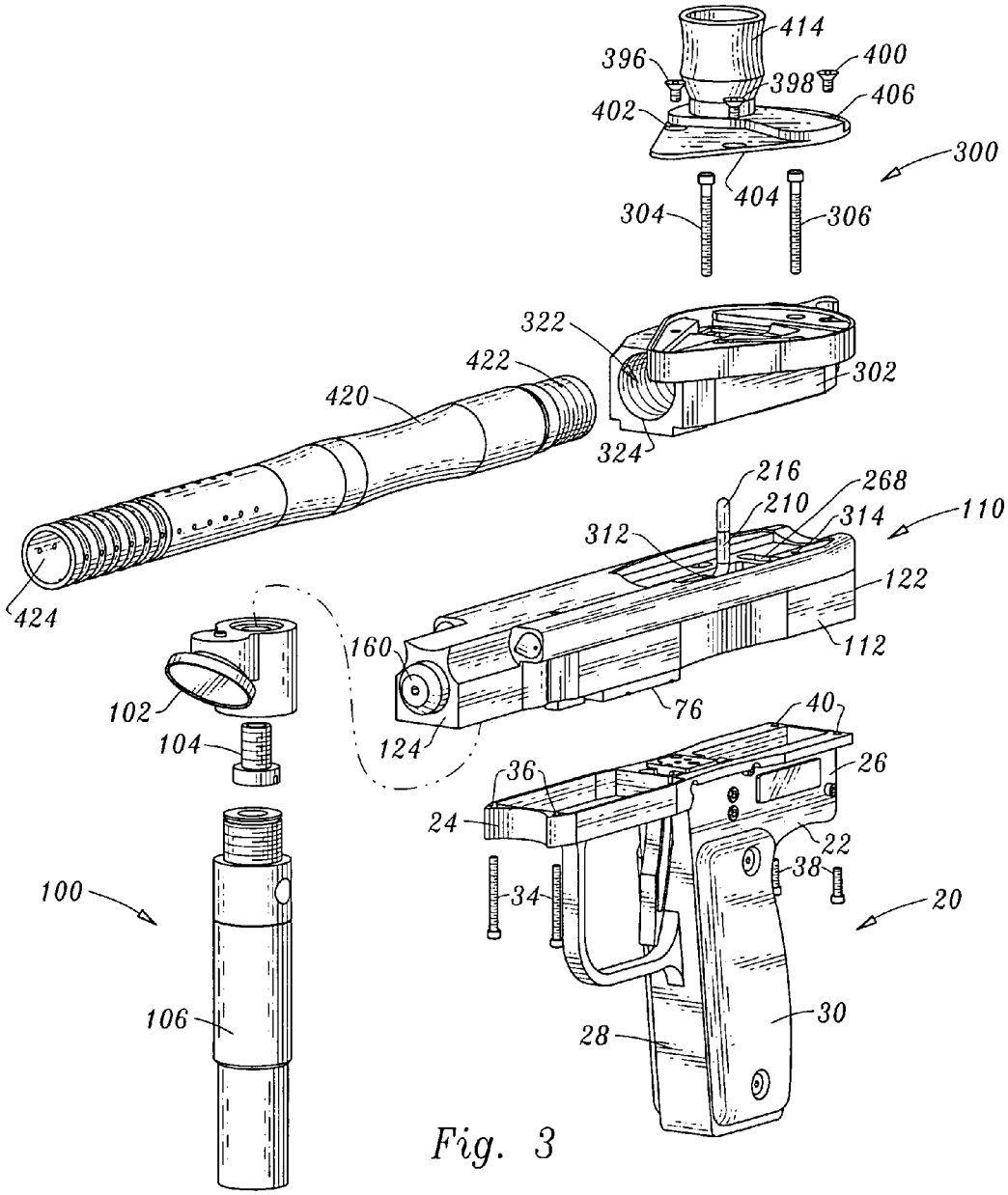
FIG. 3 is a general exploded parts view of the paintball marker shown in FIGS. 1 and 2.
Figure 6:
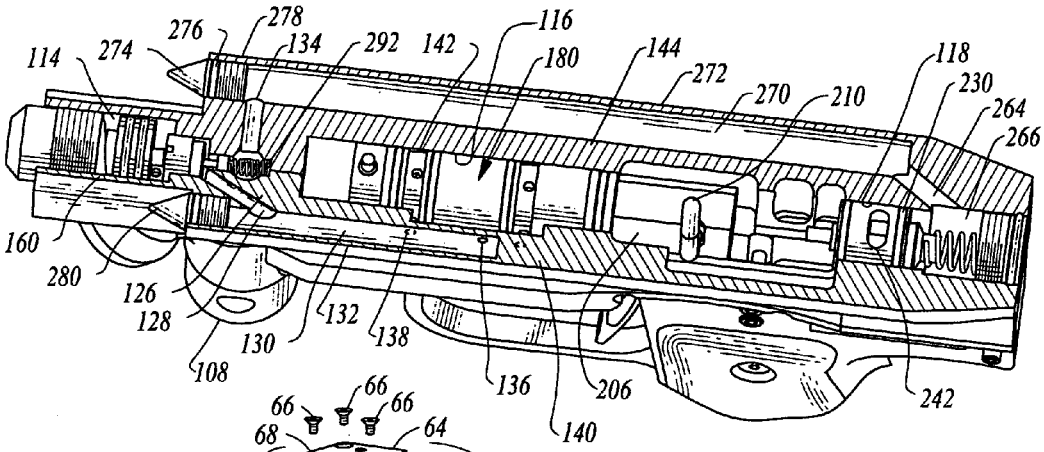
FIG. 6 is a cross sectional view of a ram housing assembly.
Figure 17:
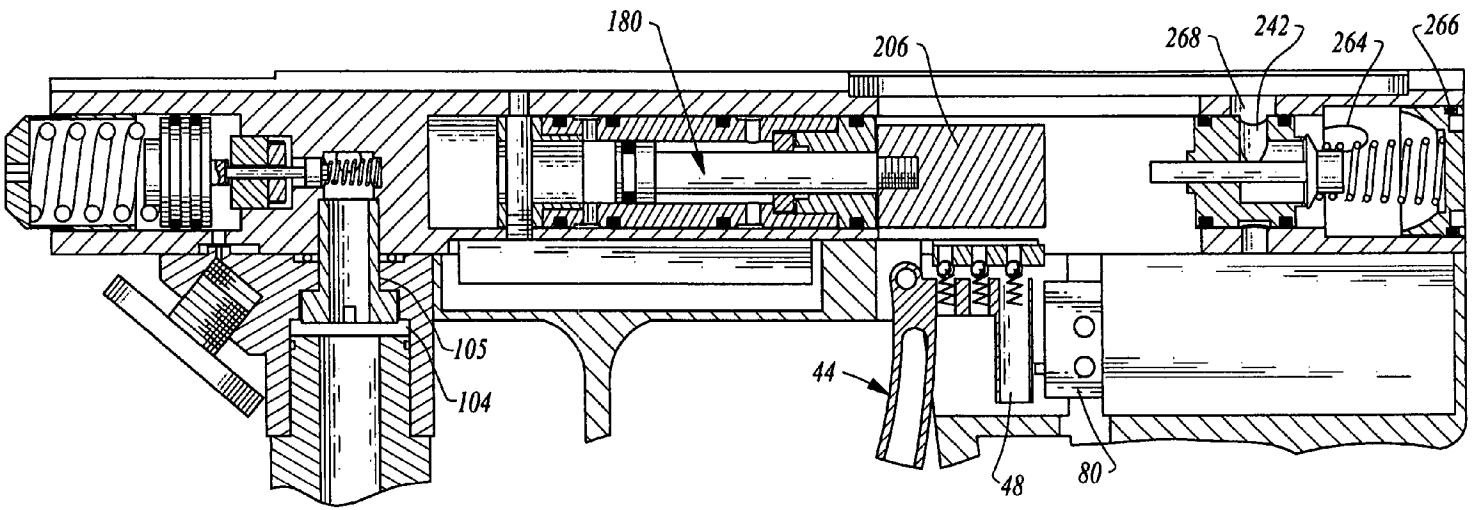
FIG. 17 is a side sectional view of the ram housing assembly showing a hammer disposed in a medial portion of the housing and shown in a first forward position and the view further showing a firing valve disposed in a reward portion of the ram housing and shown closed.

More specifically, and referring to FIGS. 1 through 3, one embodiment of the invention provides a pneumatic paintball marker 10 comprised of a trigger frame assembly 20 including a trigger frame 22 having a forward end 24 and a rearward end 26, a high pressure regulator assembly 100 operatively coupled to a source of compressed gas 108, housing assembly 110 for an actuator or ram, including a ram housing 112 supporting a front low pressure regulator valve assembly 160 (referred to as the low pressure assembly in FIG. 5) in a front bore 114, a ram assembly 180 in a medial bore 116, and a rear firing valve 230 (also referred to as an assembly 230) in a rear bore 118, please see FIGS. 6 and 17. Preferably, the ram assembly 180 acts as the actuator 180, with the actuator 180 preferably being a linear actuator. In the preferred embodiment, these terms "ram assembly, actuator and linear actuator are interchangeable. The pneumatic paintball marker 10 is further comprised of an elongated barrel 420 having an entrance end 422 and an exit end 424 and a barrel housing assembly 300 including a barrel housing 302 having a hollow open ended firing chamber 322 extending there through, the firming chamber 322 comprising a first open end 324 and a second open end 326 (FIG. 20), the first open end 324 is operatively coupled to the entrance end 422 of the barrel 420 for propelling a fired paintball out the exit end 424 thereof and the second open end 326 is closed by a removable back plug 334 (FIG. 20) for allowing easy cleaning of the pneumatic paintball marker 10.

Figure 4:
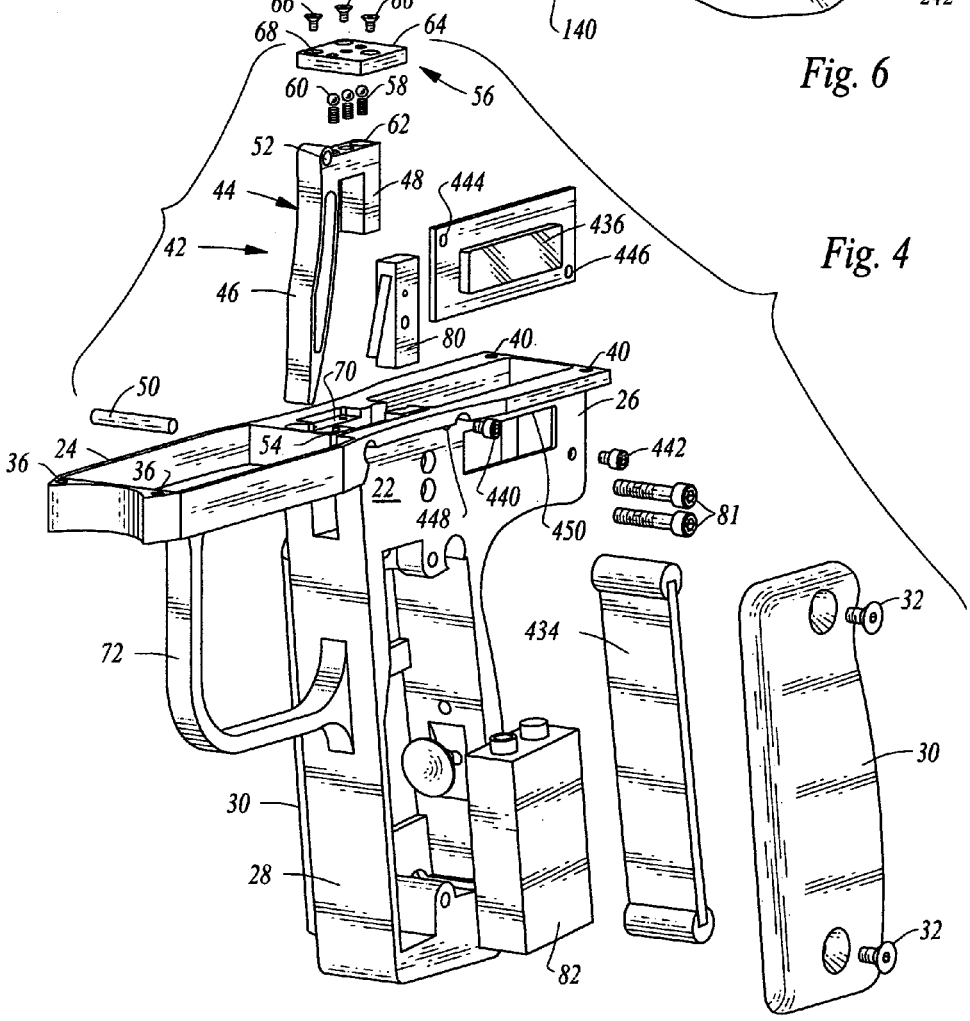
FIG. 4 is a general exploded parts view of a trigger housing assembly.

Referring to FIG. 4, the trigger frame 22 preferably includes a handle member 28 depending from the rearward end 26 of the trigger frame 22 and having a grip 30 attached with fasteners 32 to each side of the handle member 28 for providing a griped handle member 28 sized and shaped to allow a user to easily grasp the marker 10, preferably in either hand. Additionally, the trigger frame 22 at least partially houses a trigger assembly 42 comprised of an inverted generally U-shaped trigger 44 having a front trigger leg 46 at a position forwardly extending from the handle member 28 of the trigger frame 22 and having a rear leg 48 disposed within trigger frame 22 at a location adjacent a switch or sensor 80 coupled to the trigger frame with treaded fasteners 81. The generally U-shaped trigger 44 is pivotally attached to the trigger frame 22 with a pivot pin 50 passing through a pivot bore 52 disposed in the trigger 44 and through a bore 54 disposed in the frame 22 at a location adjacent an underside of the ram housing assembly 110, forward on the trigger frame 22, and in front of the grip member 28.

Additionally, the trigger assembly 42 includes a spring biased ball detent assembly 56 such that the ball detent assembly biases the trigger 44 away from the switch to provide a normally open condition as well as providing tactile feed back when actuated. The spring biased ball detent assembly 56 is comprised of a plurality of springs 58 and balls 60 forming pairs each received within a blind bore 62 disposed on a top portion of the trigger 44 such that each ball 60 follows the insertion of each spring 58. A cover plate 64 closes the blind bores 62 of the trigger locking the spring and ball pair therein by way of fasteners 66 passing through apertures 68 disposed in the cover plate 64 and threadedly fastening with treaded bores 70 disposed in the trigger frame 22. A guard 72 is preferably located forward of and beneath the trigger 44 to decrease the possibility of accidental toggling of the trigger 44 and closing of the switch or sensor actuation.

Figure 5:
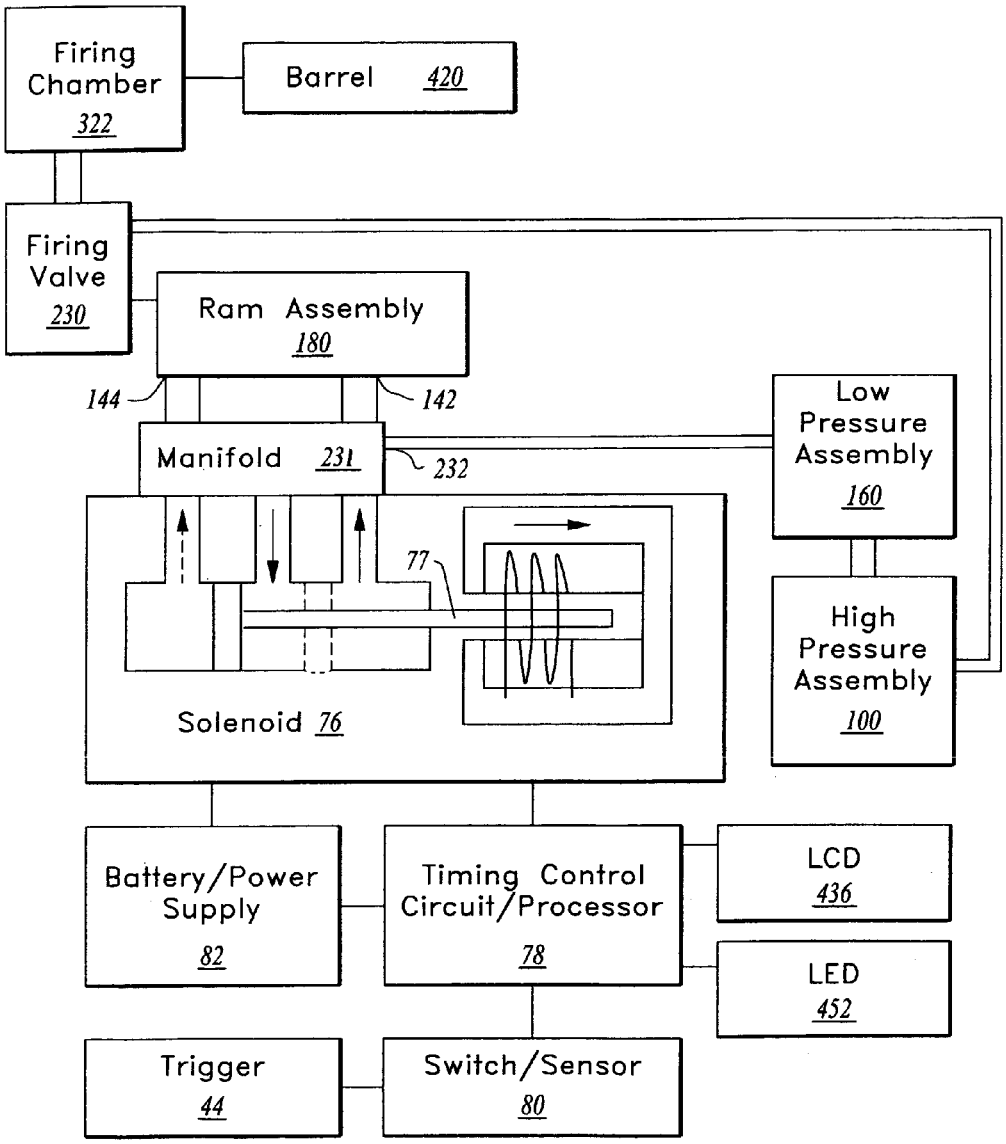
FIG. 5 is a general diagrammatical view of a paintball marker of this invention.

Referring to FIGS. 4 through 6, the trigger assembly 42, in one embodiment of the invention, includes an electronic trigging system comprised of at least one solenoid 76, a timing control circuit/processor electronics 78, the switch or sensor 80, and a battery 82 which provides power to the triggering system as required. Additionally, the trigger assembly includes a circuit board 434 fitted within the handle member 28 of the trigger frame for supporting the timing control circuit/processor electronics 78. Furthermore, an LCD 436 can be provided for providing visual feed back to the user correlative to marker information and can be coupled in a window 438 in the frame 22 via fastener 440, 442 passing through LCD apertures 444, 446 and threading into threaded bores 448, 450 of the trigger frame 22. Moreover, one or more light emitting diodes 452 can also be provided for providing visual feed back to the user correlative to marker information.

As noted herein above, the trigger 44 is pivotally coupled adjacent the trigger switch 80 for engagement therewith when actuated. The trigger switch 80 is operatively coupled to the timing control circuit/processor 78 which, in turn, is coupled to the solenoid 76. The solenoid 76 is in communication with the source of compressed air 108 originating at the high pressure air regulator assembly 100 by means of the low pressure regulator valve assembly 160.

Figure 7:
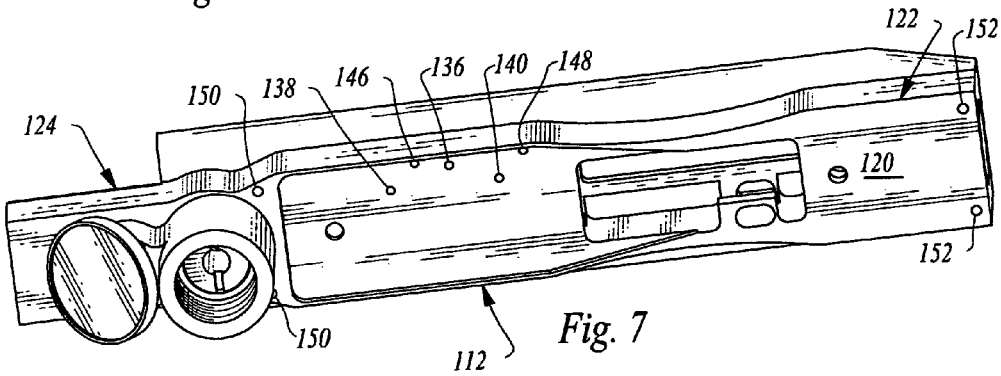
FIG. 7 is a bottom view of the ram housing assembly.
Figure 8:
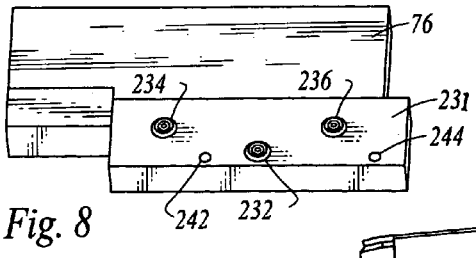
FIG. 8 is a bottom view of a solenoid mated to a manifold.
Figure 10:
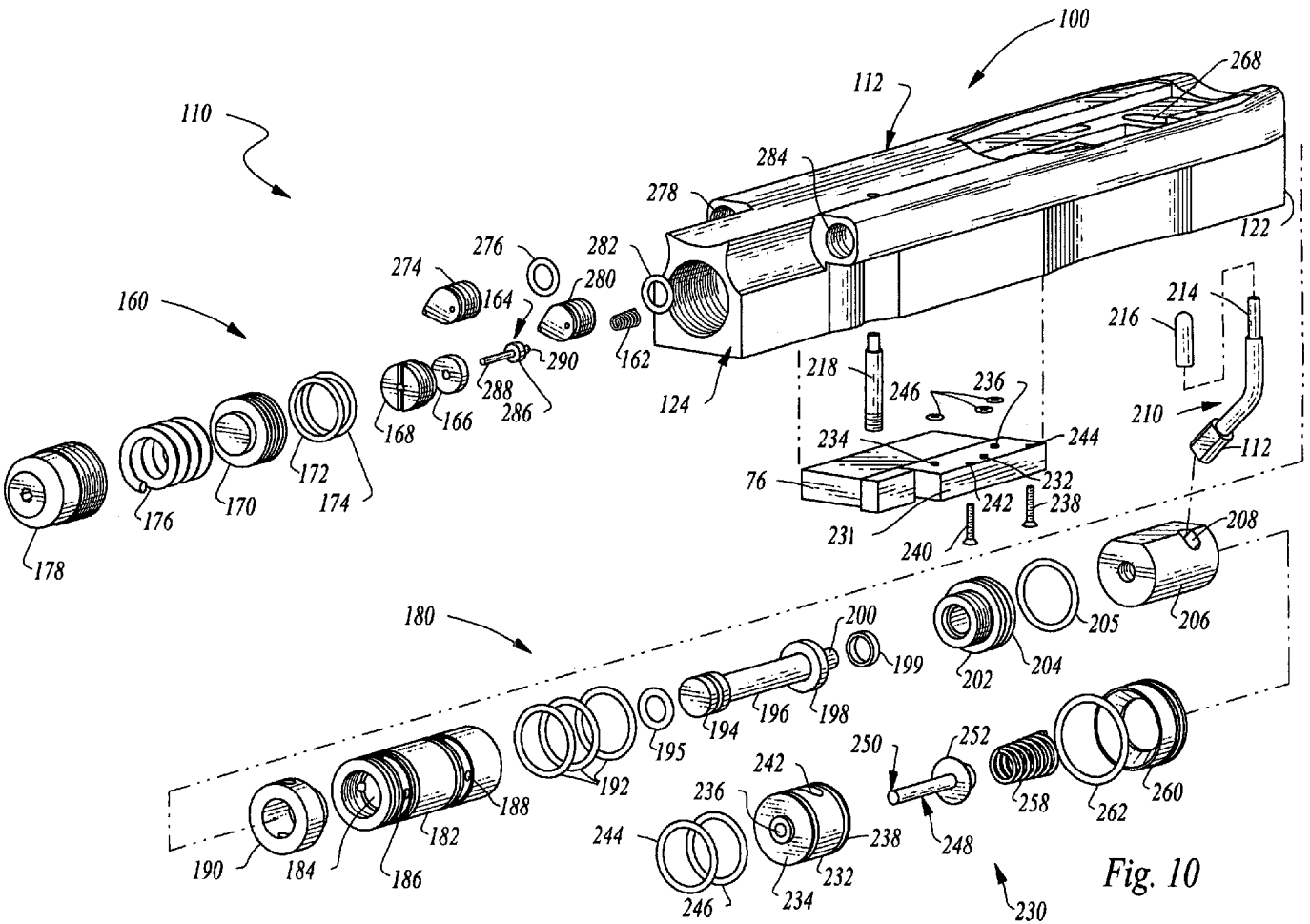
FIG. 10 is an exploded parts view of the ram housing assembly.

Specifically, and referring to FIGS. 6 through 8, the low pressure regulator valve assembly 160 receives compressed gas from source 108 via passage 126. In turn, the low pressure air regulator assembly 160 provides compressed gas to the solenoid via a passage 128 extending between the low pressure regulator valve assembly 160 and a dedicated air rail passage 130 forming a blind bore in a first air rail 132 closed at an open forward end by cap 280 passing through an O-ring 282 and threading into threaded bore 284 (FIG. 10). The dedicated air rail passage 130 terminates to a port 136 in the ram housing 112 which in turn is operatively coupled to a port 232 on a manifold 231 which is operatively coupled between the solenoid 76 and the ram housing 112 for providing compressed low pressure air into the solenoid 76.

Figure 9:
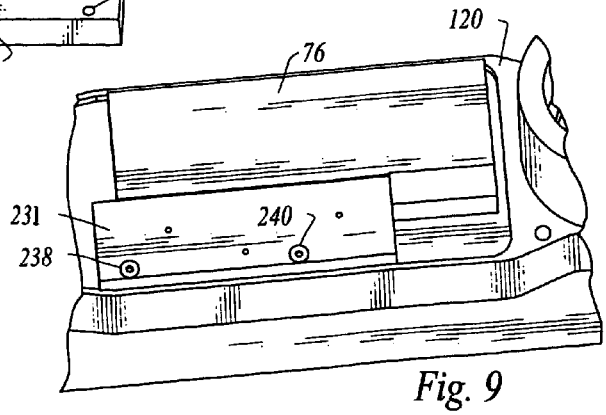
FIG. 9 is a bottom view of the solenoid mated to the ram housing assembly.

The ram housing 112 includes port 136 extending from the dedicated air rail passage 130 in the first air rail 132 to an underside 120 of the housing 112. Additionally the ram housing includes ports 138, 140 which traverse form the underside 120 of the housing 112 to a forward portion 142 and a reward portion 144 of the ram bore 116, respectively. 82. Referring to FIGS. 8 and 9, the manifold 231 is operatively coupled to the solenoid 76 by way of, for example, fasteners 238, 240 passing through holes 242, 244 in the manifold 231 and threading into threaded bores 146, 148 provided in the underside 120 of the ram housing 112 such that the outlets 232, 234, and 236 mate with ports 136, 138, and 140 respectively such that under the orchestration of the timing control circuit 78 the solenoid 76 alternately air charges the two different portions 142, 144 of the ram bore via ports 138, 140 thereby reciprocating a piston in the ram for initiating the loading and firing sequences.

Thus, toggling of the trigger 44 causes activation of the trigger sensor or switch 80 which signals the timing control circuit 78 (FIG. 5) into a firing sequence. This firing sequence first causes energizing of solenoid 76 located in front of and above the trigger 44. The energizing of solenoid 76 moves a solenoid pin 77 within solenoid, in turn causing compressed air to reverse its flow from the forward portion 142 to the rearward portion 144 of ram bore by reversing the air flow through the solenoid and subsequently on through the mated manifold 231 and then through the air passages within the housing 112 to the ram 182 of assembly 180 for carrying out the firing sequence and, wherein on the command of the timing control circuit 78 (in the form of a processor receiving input from the trigger sensor 80 coupled to the trigger 44) and solenoid 76, air alternately charges two different sides of the ram assembly thereby reciprocating a piston 198 in the ram 182 and initiating the firing and loading sequences. This electronic firing of the marker by at least the one solenoid 76, the timing control circuit 78, the trigger 44, the switch or sensor 80, and the battery or other power source 82 allows for more exact timing of firing thereby providing faster more controlled firing of the marker with less ball breakage.

Referring back to FIGS. 3 and 7, the trigger frame assembly 20 is operatively coupled to the ram housing assembly 110 such that the trigger frame 22 is disposed and coupled to the underside 120 and rearward end portion 122 of the ram housing 112 by, for example, a pair of front threaded fasteners 34 respectively passing through a pair of openings 36 in the trigger frame 22 and respectively threading into a front pair of threaded bores 150 disposed in the underside 120 of the ram housing 112 and a pair of back threaded fasteners 38 respectively passing through a pair of openings 40 in the trigger frame 22 and respectively threading into a rear pair of threaded bores 152 disposed in the underside 120 of the ram housing 112.

Additionally, the high pressure regulator assembly 100 is also operatively coupled to the ram housing assembly 110 and is threadedly coupled underneath and at a forward end 124 of the ram housing 112 and is comprised of a gauge 102 coupled to the ram housing 112 via a threaded fastener 104 threaded into a threaded bore 105 (FIG. 17) disposed in a forward end 128 of the ram housing 112 and a regulator body 106 threadedly coupled to the gauge 102 at one end and to a source of compressed gas 108 at an opposing end.

Referring to FIG. 10 and back to FIGS. 1–3 and 6, and in one embodiment of the invention, the ram housing assembly 110 is comprised of the low pressure regulator valve assembly 160 interposed between the high pressure regulator 100 and the solenoid 76 for providing compressed air pressure reduction. The low pressure regulator valve assembly 160 is disposed within the cylindrical bore 114 in the front of the ram housing 112 and is comprised of a spring 162, a low-pressure pin 164 comprised of a piston 286, a front end 288, and a rear end, a seal 166, a seal cap 168, a piston 170 having an O-rings 172, 174, a spring 176, and an adjustable cap 178 which are inserted into the cylindrical bore 114 in the order as shown in FIGS. 10 and 6. Referring to FIG. 6, the low pressure regulator valve assembly 160 receives compressed gas from source 108 via passage 126.

The seal 166 is held in place by the seal cap 168 which is cupped. The seal 166 provides a divider between the high-pressure air and the subsequent low-pressure compressed air. The low-pressure air then passes through port 128 to the low-pressure compressed air rail 132. Low-pressure pin 164 is held in a closed position by the use of the spring 176 which constrains movement. The low-pressure pin 164 is held in alignment through seal 166 and is acted upon by piston 170 in response to the bias of the spring 176 wherein the piston 170 is slideably supported within the cylindrical bore 114 in the front of the ram housing and the piston position being governed by the spring 176 held in place by the adjustment knob 178 for adjusting the air volume escaping around pin 164 and through seal 166 thus translating into desired lower pressure compressed air. In a manner novel in the art, the low-pressure pin 164 extends forward through the seal and back ward such that a back section of the pin 164 has a circumscribing spring 162 and terminates to end 290 which resides within a blind bore 292 disposed in the housing 112 (FIGS. 6 and 10) for further slideably supporting the low-pressure pin 164 and additionally aligning the low-pressure pin 164 through the seal 166 for improving pressure regulation.

Still referring to FIG. 10 and back to FIG. 6, and in one embodiment of the invention, the ram housing assembly 110 is further comprised of the generally cylindrical ram assembly 180 disposed within the cylindrical medial bore 116 disposed in a generally central position in the ram housing 112 by the use of a setscrew 218. It should be noted that the generally cylindrical ram assembly 180 is located parallel and directly below the barrel 420 and firing chamber 322 but, in fact, the ram assembly 180 could be located at a variety of different location within the ram housing 112. The generally cylindrical ram assembly 180 is disposed within the medial bore 116 in the order as shown in FIGS. 10 and 6 is comprised of a ram body 182 having a central bore 184 extending therethrough and forward and rearward ports 186, 188 for receiving and exhausting of air sent through the solenoid 76. Seals 192 are disposed around a front ram cap 190 and the ram body 182 so that gas leakage around the ram body 182 and front ram cap 190 is substantially eliminated. A ram piston 194 is slideably supported within the bore 184 of the ram body 182 and includes a seal 195 so that gas leakage around the ram piston 194 is substantially eliminated. A rod 196 is coupled to the piston 194 and extends rearward to a flange 198 and beyond to a threaded end 200 coupling to hammer 206. The threaded end 200 extends through a rear ram ring 199. A ram back cap 202 seals a rear of the ram body 182 and houses a magnet 204 that attracts the piston and/or rod 194, 196 to the ram bore 184 for delaying movement of the ram assembly 180 until increased air pressure has built up. Seal 205 is provided around cap 202 so that gas leakage around the cap 202 is substantially eliminated. A generally cylindrical impacting hammer 206 is coupled to the rod 196 at threaded end 200. A connecting rod 210, having the appearance somewhat of an arm bent at the elbow, includes one end 212 coupled to a opening 208 in the hammer 206 and another end 214 terminating to a rotatable connecting rod end cap 216 and operatively coupled to the door 360 by being received within a cam groove or slot 370 provided within the door 360.

Figure 11:
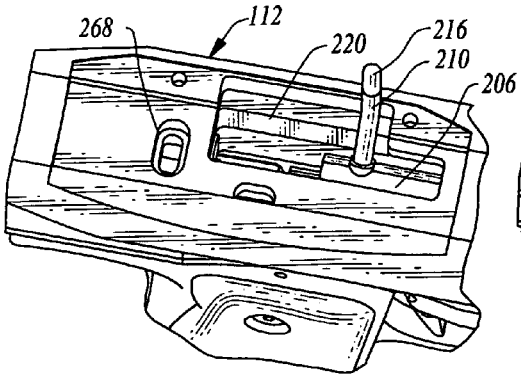
FIG. 11 is a top perspective view of the ram housing assembly showing the hammer and connecting rod in a first forward loading position.
Figure 12:
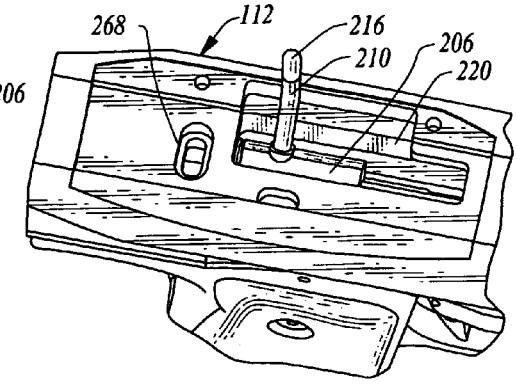
FIG. 12 is a top perspective view of the ram housing assembly showing the ram and hammer in a second rearward firing position.
Figure 13:
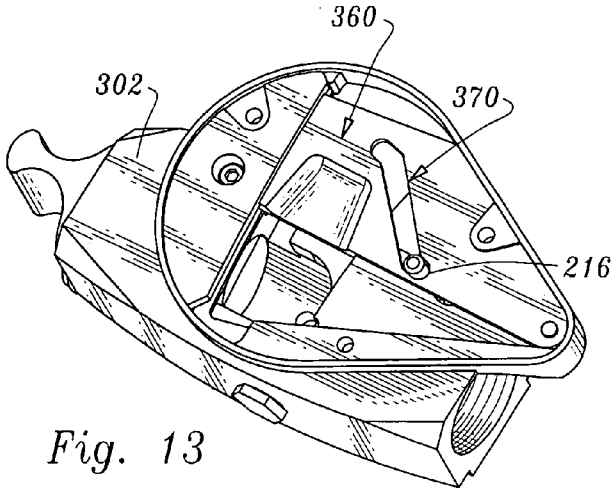
FIG. 13 is a perspective top view of the barrel housing showing a door in an open position and showing a back plug disposed therein.
Figure 14:
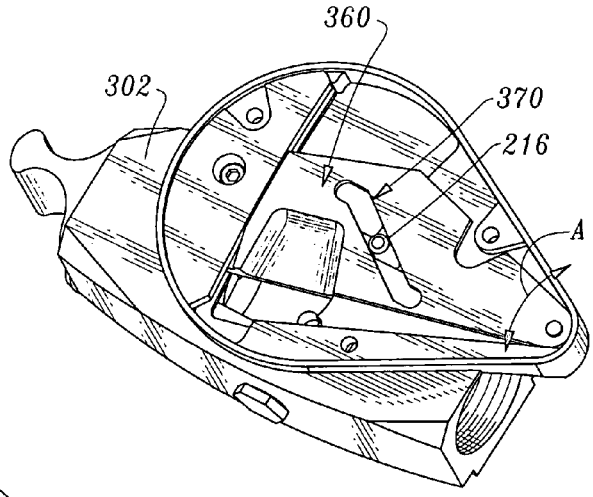
FIG. 14 is a perspective top view of the barrel housing showing the door in semi open/closed position and showing a back plug disposed therein.
Figure 15:
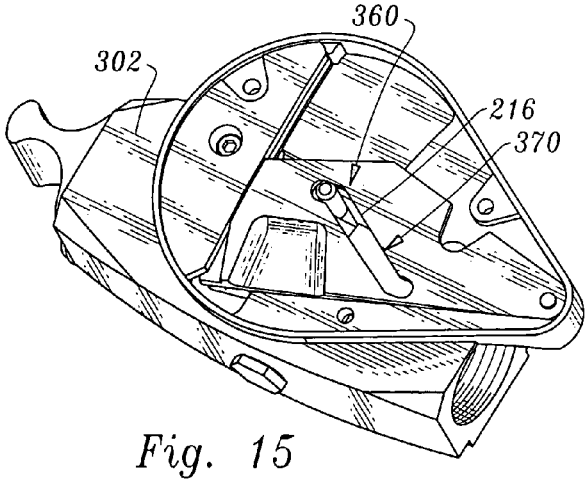
FIG. 15 is a perspective top view of the barrel housing showing the door in a closed position.

Referring to FIGS. 11 through 12 and back to FIG. 6, compressed gas entering the rearward portion 144 of the ram blind bore 116 drives the position of the hammer 206 through a fore and aft action within ram blind bore 116 while moving the connecting rod 210 within a slot 220 milled in the ram housing 112 from a forward position FIG. 11 to a rearward position FIG. 12 for pivoting the door 360 between a first and a second position or between an open position as shown in FIG. 13 through a medial position as shown in FIG. 14 and to a closed position as shown FIG. 15.

Figure 16:
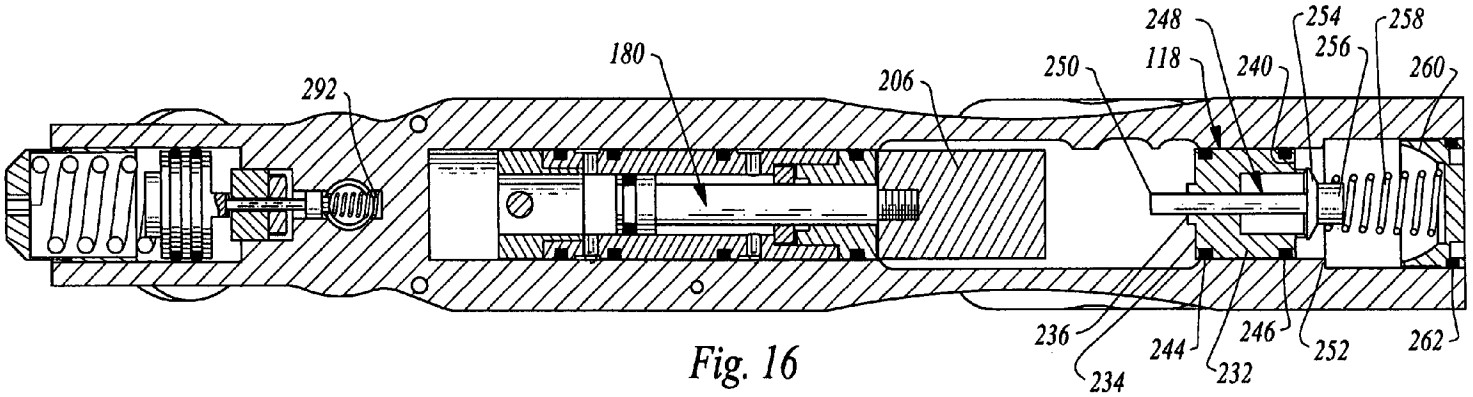
FIG. 16 top sectional view showing the ram housing assembly showing a hammer disposed in a medial portion of the housing and shown in a first forward position and the view further showing a firing valve disposed in a reward portion of the ram housing and shown closed.

Referring to FIGS. 16 and 17 and back to FIG. 10, and in one embodiment of the invention, the ram housing assembly 110 is further comprised a normally closed, impact opening, pin valve or firing valve assembly 230 located in the valve back bore 118 in the order as shown in FIGS. 10 and 16. The firing valve 230 is preferably impact opening, pin valve assembly includes a generally cylindrical hollow valve insert 232 having a sealed front end 234 having a central hole 236, an open back end 238 having an annular valve seat 240, and a sidewall opening 242 leading to a vertical bore 268 in the ram housing in communication with an opening in a back portion of the firing chamber. The insert includes O-rings 244, 266 so that gas leakage around the insert 232 is substantially eliminated and the insert 232 can be fixed in position by a setscrew. A valve pin 248 includes a front pin end 250 that extends through the opening 236 in the sealed front end 234 of the insert 232 and terminates in a face to face relation with respect to the hammer 206 of the ram assembly 180. The valve pin 248 extends rearwardly and terminates to valve end 252 having a top hat shaped end comprised of a brim portion 254 and a top portion 256 such that the brim portion 254 closes the open rearward end 238 of the insert by being seated on valve seat 240 under the bias of a spring 258 that is sandwiched between the top portion 256 of the valve end 252 and a rear end cap 260 closing the valve back bore 118.

Referring to FIG. 17 and back to FIG. 6, a passage 264 extends between a rear cavity 266 and a passage 270 forming a blind bore in a high pressured rail 272 of the ram housing 112 which is closed at an open forward end by cap 274 passing through an O-ring 276 and threading into threaded bore 278.

Figure 18:
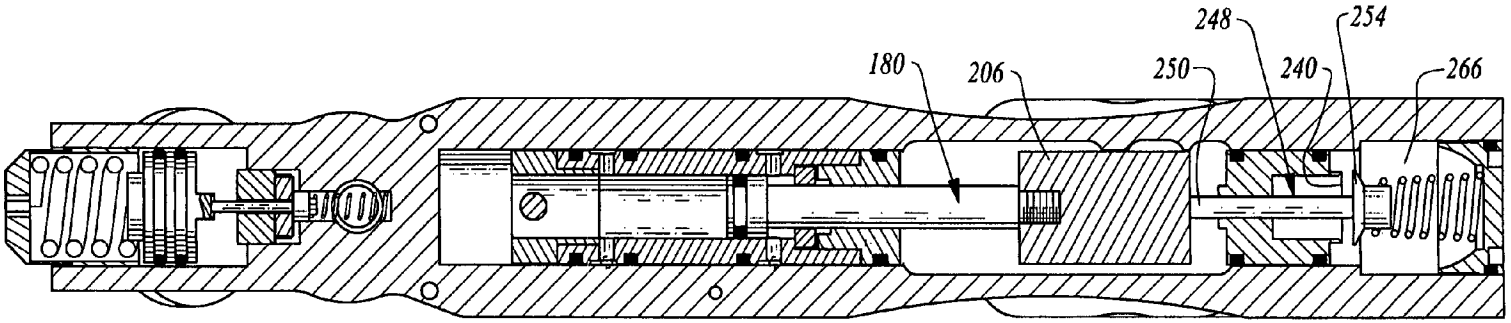
FIG. 18 top sectional view showing the ram housing assembly showing a hammer disposed in a medial portion of the housing and shown in a second rearward position and the view further showing a firing valve disposed in a reward portion of the ram housing and shown open.
Figure 19:
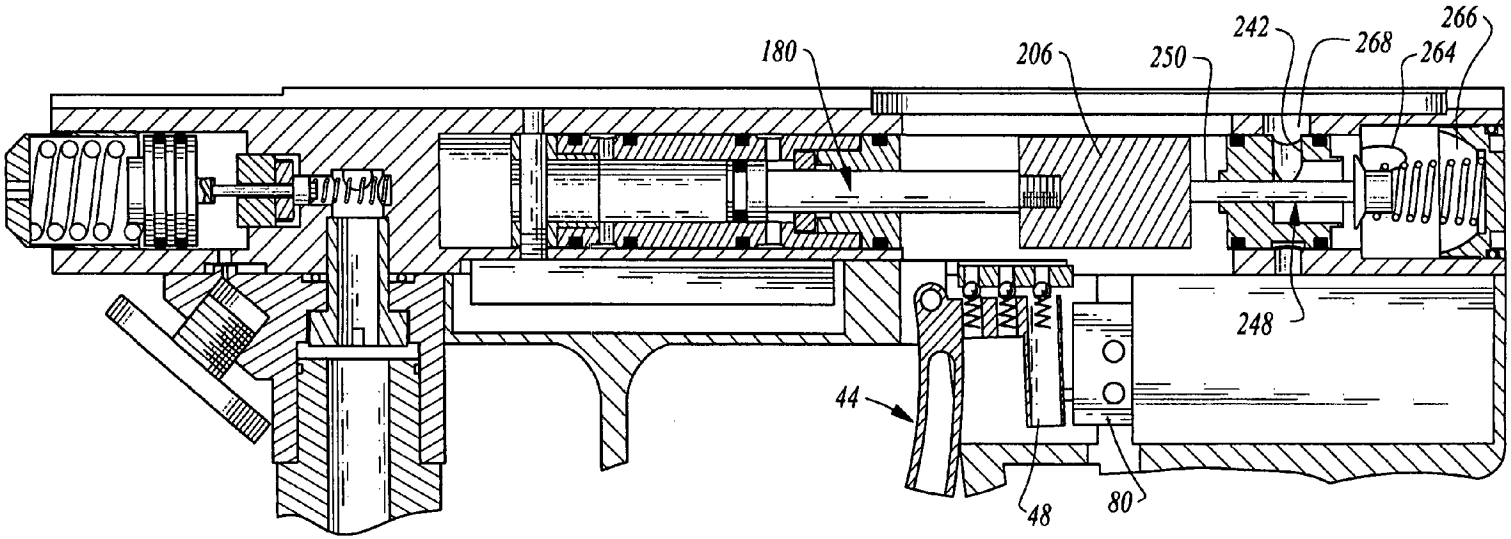
FIG. 19 is a side sectional view of the ram housing assembly showing a hammer disposed in a medial portion of the housing and shown in a second rearward position and the view further showing a firing valve disposed in a reward portion of the ram housing and shown open.

Referring to FIGS. 18 and 19 and back to FIG. 6, the high pressured rail 272 of the ram housing 112 is in open communication with the high pressure regulator 110 via passage 134 for feeding compressed through passages 270 and passage 264 and into cavity 266 such that the firing valve 230 allows the air into the firing chamber 322 as a result of the hammer 206 acting on the pin end 250 and pushing the pin 248 backward thereby opening communication between the back cavity 266 and the firing chamber 322 by way of the sidewall opening 242 in the insert 232 and the escape hole 268 in the ram housing 112.

Figure 21:
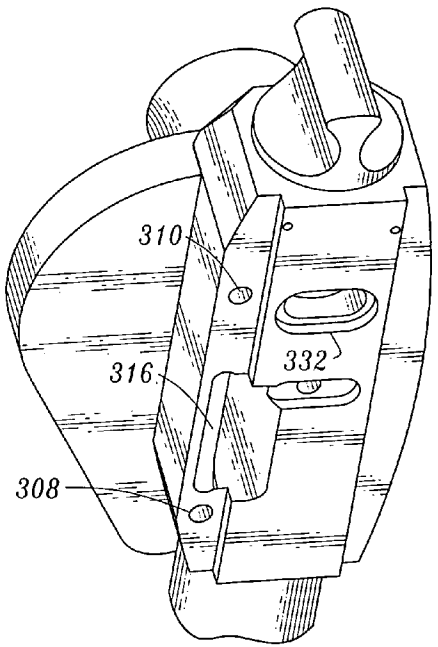
FIG. 21 is a bottom view of a barrel housing assembly.
Figure 20:
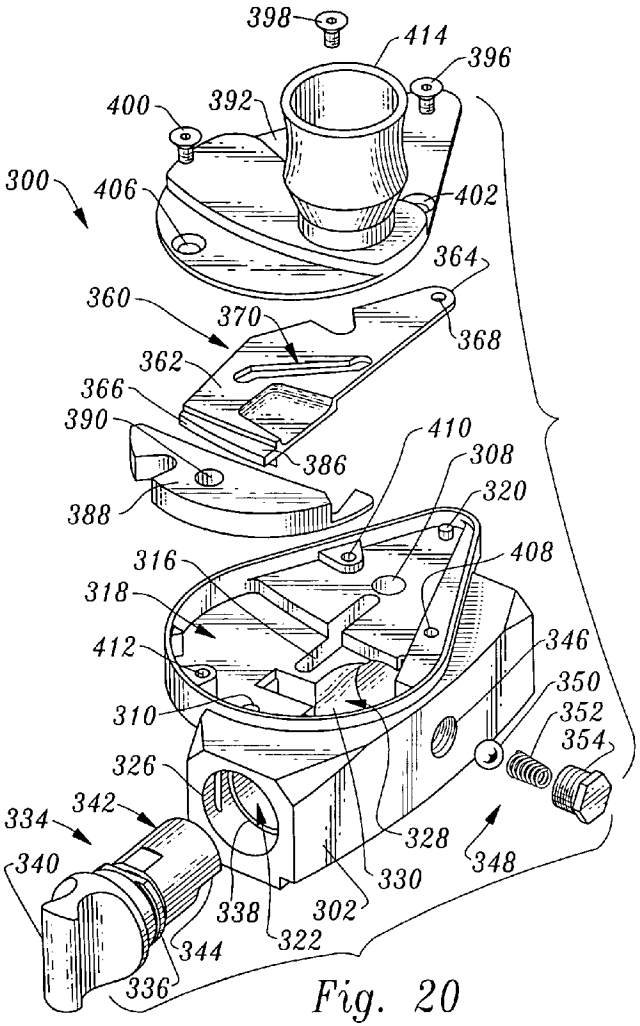
FIG. 20 is an exploded parts view of a barrel housing assembly.

Referring to FIGS. 20 and 21 and back to FIG. 3, the barrel housing assembly 300 is comprised of a barrel housing 302 surmounting the ram housing assembly 110 at a rearward end portion 122 thereof and is operatively coupled thereto by, for example, a pair of threaded fasteners 304, 306 passing through openings 308, 310 disposed in the barrel housing 302 and respectively threading into threaded bores 312, 314 provided in the ram housing 112. It should be noted that when the barrel housing assembly 300 is operatively coupled to the ram housing assembly 110 the connecting rod 210 of the ram assembly 180 extends through an opening 316 in the barrel housing 302 and terminates in a top cavity 318 of the barrel housing 302 to a rotating cap 216 rotatably coupled within a cam groove 370 of a door 360 pivotally coupled within the top cavity 318 by axis pivot pin 320.

The barrel housing 302 includes a hollow open ended firing chamber 322 extending therethrough, the firming chamber 322 comprising a first open end 324 and a second open end 326, the first open end 324 is operatively coupled to the entrance end 422 of the barrel 420 for propelling a fired paintball out the exit end 424 thereof and the second open end 326 is closed by a removable back plug 334 for allowing easy cleaning of the pneumatic paintball marker 10. The pneumatic paintball marker further includes a paintball-loading hole 328 in a side wall 330 thereof at a location between the back plug 334 and the barrel 420 and includes the pivoting door 360 surmounting the firing chamber 322 and pivotally coupled to the housing 302 for providing access to the paintball-loading hole 328 and firing chamber 322 when the door 360 is pivoted to an open position and for sealing the firing chamber 322 when the door is pivoted to a closed position. Additionally, it should be noted that the back top opening or escape hole 268 of the rear bore 118 supporting the firing valve 230 mates with a back bottom opening or bottom escape hole 332 disposed in the barrel housing 302 which is in open communication with the firing chamber 322 such that an open line of communication is provided between the escape hole 268 of the rear bore 118 supporting the firing valve 230 and the firing chamber 322.

The barrel housing assembly 300 is further comprised of a detent assembly 348 including a ball 350, a spring 352, and a threaded plug 354 received within a threaded bore 346 of the barrel housing 302 in the order shown in FIG. 20. The ball 350 extends through the sidewall of the firing chamber 322 as shown in at FIGS. 13 and 14.

As noted above, the firing chamber 322 is sealed by the back plug 334, which is particularly configured to be quickly and easily removed by the means of a twisting, locking feature comprised of tabs 336 disposed on the back plug 334 and fitting within complemental grooves disposed in a rim 338 in the firing chamber 322 proximate the back opening 326 such that when the tabs are inserted into the groove of the rim 338 and twisted the tabs lock behind the rim 338 of the firing chamber 322. The firing chamber 322 can also be sealed by the back plug 33 by means of a threaded of the back plug with the open ended firing chamber. Uniquely, the back plug 334 does not move during the loading and firing of chamber 322. Rather, the back plug 334 is only removed when cleaning the firing chamber 322 and barrel is required, such as when a paintball ruptures within the firing chamber 322 or barrel. The back plug 334 also locates the paintball in place within the firing chamber 322 by having a protrusion 342 at a forward end that at least partially protruding into the firing chamber 322. The back Plug 334 a minor portion or cut portion 344 for enabling air to transition, changing direction from a vertical to a horizontal flow, from the firing valve 230 through passages and ports in housing assemblies into firing chamber 322. The transition between the port 332 and chamber 322 being smoothed by a radius in the back plug 334 where the full cylinder has the minor cut on the bottom on the back plug 334. Additionally, the back plug has a narrowing flange 340 on the portion located outside the housing 302 to enable the user to twist the back plug 334 enabling removal of the back plug. Optionally, the minor cut in back plug can be of different heights and or shapes including minor or major cuts.

Referring to FIG. 20 and in one embodiment of the invention, the door 360 is shown having a generally triangular or pyramid shape body 362 with a front corner 364, and a rear corner 366 being rounded off. The front corner or pivoting end 364 includes a hole 368 there through for allowing the axis pivot pin 320, which is the axis for the pivoting of the door 360, to pass there though and into the top cavity 318 of the barrel housing 302.

Figure 22:
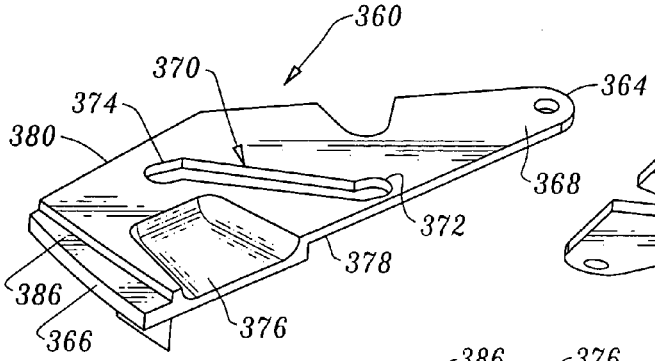
FIG. 22 is a top perspective view of the door of the barrel housing assembly.

FIG. 22 shows a top view of the door 360 having a cam slot or groove 370 of a check or extended V shaped cut at each end through the door 360 and extending between an sides 378 and 380 of the door 360. This cam slot or groove 370 acts as a cam for the moment of the door 360 wherein the cam groove 370 is designed for receiving the sliding movement of the connecting rod cap 216 of the connecting rod 210 in a manner causing closing and opening of the door 360 for the sealing and opening of the firing clamber 322. Additionally it is seen that the door 360 includes a beveled depression 376 on the side 378 adjacent the paintball-loading hole 328 and adjacent end 366 opposite the axis point or pivoting end 364. This depression allows a paintball which is to be fired next, to rest as close to the firing chamber 322 as is practical.

Figure 23:
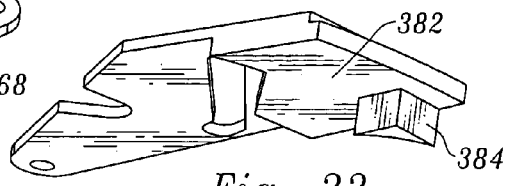
FIG. 23 is a side and bottom perspective view of the door of the barrel housing assembly.

FIG. 23 shows a bottom view of the door 360 having a step 382 with stepped sides, the stepped sides themselves being curved in nature. The step 382 in door 360 is designed to allow sealing by the door 360 of firing chamber 322 by pivoting of the door 360 into the closed position within the top cavity 318 of the barrel housing 22. Additionally, the step 382 in the door 40 includes a minor extension 384 protruding from the door, itself a sculpted though generally triangular shape. Minor extension 384 is designed to extend into the firing chamber 322, coming into contact with the paintball causing paintball to be at least partially pushed from firing chamber 322 into the elongated barrel 420.

Figure 24:
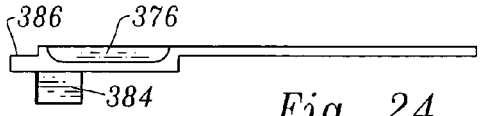
FIG. 24 is a side perspective view of the door of the barrel housing assembly.

FIG. 24 shows a side view of the door 360 revealing a narrowing of the door forming door rail 386 adjacent end 366 or at the bottom of the pyramid, the door rail 386 being contained within a door guide 388 connected to the body by having fastener 306 passing through and aperture 390 in the door guide 388 and coupling to threaded bore 314 in the ram housing 112. Please see FIGS. 13 through 15. The principle being that door 360 rides upon and friction to movement of door 360 by connecting rod 210 is, almost exclusively, the axis pinhole 364 and the door rail 386. From the side view, the appearance of the door 360 is stepped with an extension, protruding from the thickest portion of the door and close to the bottom, giving the door an overall "L" appearance. The "L" extension 384 facilitates the transitioning of the paintball from the loading chamber at least partially into the barrel.

Figure 25:
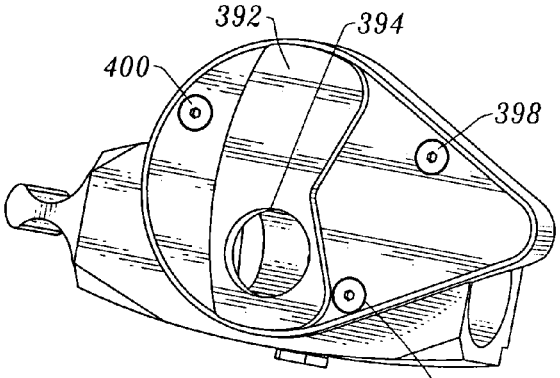
FIG. 25 is a perspective top view of the barrel housing showing a top plate having an aperture leading to a firing chamber.
Figure 26:
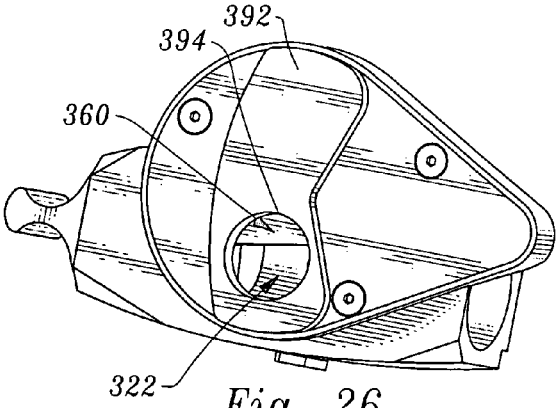
FIG. 26 is a perspective top view of the barrel housing showing a top plate having an aperture leading to a firing chamber and partially covered by partially closed door.

Referring to FIGS. 25 and 26 and back to FIGS. 20 and 3, the barrel housing assembly 300 is further comprised of a tear dropped face shaped top plate 392 which is received in and complemental in shape to cavity 318 and which overlies the pivoting door 360 (shown in an open position in FIG. 25 and in a partially closed position in FIG. 26) and includes an eye opening 394 there through. The top plate 392 is coupled to the barrel housing 302 by way of fasteners 396, 398, and 400 respectively passing through openings 402, 404, and 406, and respectively threading into threaded bores 408, 410, and 412 disposed in the barrel housing 302. An open ended feed tube 414 is includes one end coupled to a paintball storage magazine (not shown) and an opposing end coupled to and circumscribing the eye opening 394 of the top plate 392 for communicating paintballs from the storage magazine, through the feed tube and top plate, past the door 360 and into the firing chamber 322 in the barrel housing 302.

Figure 27:
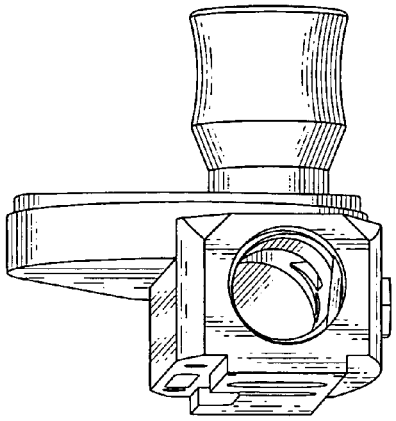
FIG. 27 a perspective back view of the barrel housing with the back plug removed and showing the door in an open position.
Figure 28:
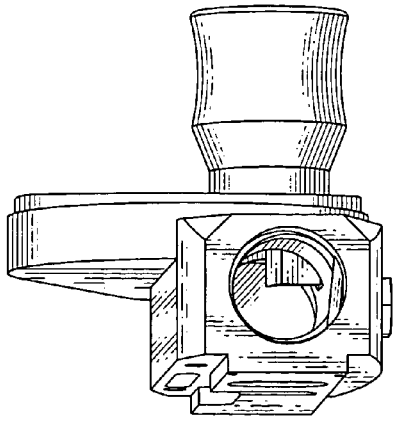
FIG. 28 is a perspective back view of the barrel housing with the back plug removed and showing the door in a partially closed position.

FIGS. 27 and 28 show the barrel housing assembly 300 with the back plug 334 removed therefrom and with the door in an open position (FIG. 27) showing that the minor extension 384 is substantially not extending into the firing chamber 322 and in a partially closed position (FIG. 28) wherein the minor extension is shown substantially extending into the firing chamber 322.

Figure 31:
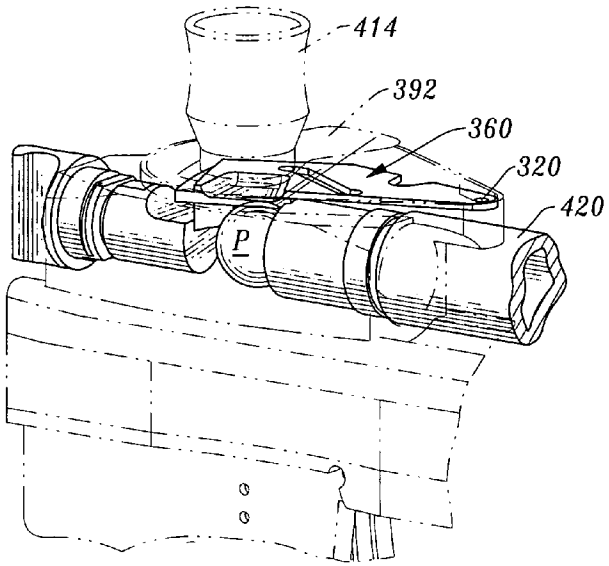
FIG. 31 is a perspective top view of the barrel housing having the barrel and back plug coupled thereto and showing a paintball in position by the closing movement of the door.
Figure 30:
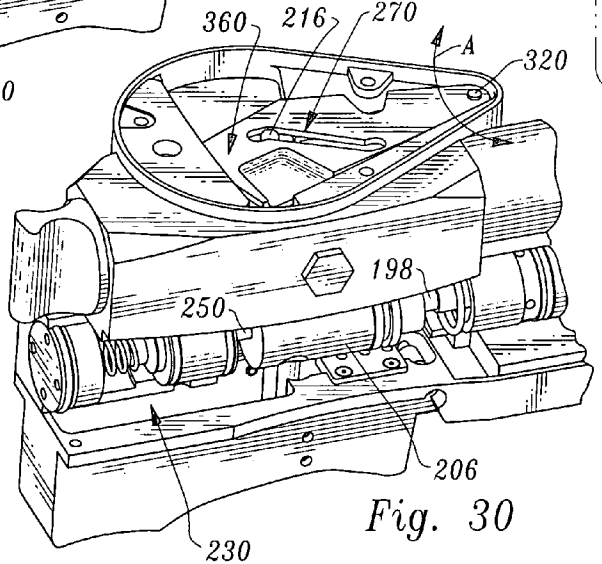
FIG. 30 is a partial cutaway view of the ram housing engaging the firing valve and a perspective top view of the barrel housing showing a door in the closed position.
Figure 29:
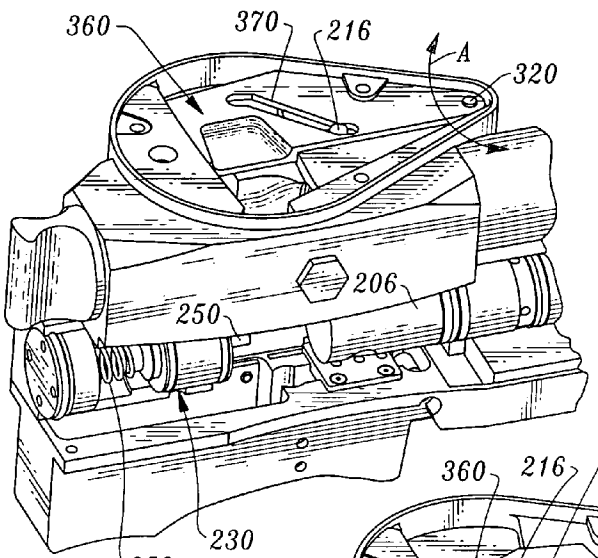
FIG. 29 is a partial cutaway view of the ram housing and a perspective top view of the barrel housing showing a door in the open position.

In use and operation, and referring in general to FIGS. 29 through 31, the pneumatic paintball marker 10, before the trigger 44 (FIG. 1) is toggled, has door 360 is in a normally open position (FIG. 29) allowing a paintball P to freely drop down through feed tube 414, through eye opening 394 of the top plate 392, past the door 360, and into the firing chamber 322 (FIGS. 31 and 26) and has a direct compressed air connection from the high pressure regulator 100 through port 134, through passage 270 and on though rear passage 264 and into cavity 266 (FIG. 6) and air is connected to the ram assembly by passing through the low pressure regulator valve assembly 160 and on through passage 128 and 130 to the manifold 231 (FIG. 6) for communicating with the forward portion of the ram body 142 and causing the piston 194 and rod 198 to be held forward in the compacted position. Please see at least FIGS. 16, 17, and 29. When the trigger is toggled the solenoid 76 reverses which changes the flow of air through solenoid 76 and the manifold 231 for directing air to the rearward portion 144 of the medial blind bore 116 for causing the piston 194 and rod 198 and, thus the connected hammer 206 coupled to connecting rod 210, to push rearward into the extended position. The extension of hammer 206 and attached connecting rod 210, first causes the connecting rod end 216 to act on the cam slot 370 of the door 360 such that the door pivots about axis pivot pin 320 along double ended arrow "A" thus closing door 360 and sealing firing chamber 322 (FIG. 30). Further full extension of the ram assembly 180 causes an impacting of hammer 206 upon the end 250 of the pin 248 of the firing valve 230 causing the door to again pivot about axis pivot pin 320 along double ended arrow "A" thus opening of firing valve 230 and escapement of compressed air upward through the valve insert body and into firing chamber 322 for expelling the paintball from the entrance end 422 and out the exit end 424 of the barrel 420. Please see at least FIGS. 18, 19, 30, and 31.

Upon firing of the paintball, the timing circuit 78 continues the firing sequence ending charging of solenoid 76, causing solenoid to again reverse, changing air flow through the solenoid 76 so that compressed air is again directed to the forward portion of the ram body 182, causing the piston 194 and rod 198 to contract such that the hammer 206 moves away from end 250 of valve pin 248, valve pin spring 258 assists in closing the firing valve 230, in turn cutting off the flow of air there through. Further movement of hammer 206 and connecting rod 210 mated to it, causing contact of the connecting rod cap 216 upon cam groove 370 in door 360 again pivoting the door on its axis pivot pin 320, opening the firing chamber 322 and allowing a paintball to drop in. User can now again toggle the switch and repeat the process. Optionally an optical sensor(s), placed in the firing chamber 322, can detect the presence or absence of a paintball. Presence of paintball would allow the toggling of the trigger to initiate the firing sequence, whereas the absent of a paintball would negate the effects of toggling of trigger in the timing circuit.

Alternate embodiments may involve the use of separating the cam from the door, such as a similar cam groove cut into a slideable unit mated to the hammer. Offset door would then communicate with cam, such as by a pin mated to the door, the door sliding within a track. The door could be two pieces with 45 degree cuts in each, instead of cut into one piece or stacked cuts. In such an arrangement the cover portion of the door would slide linearly in a direction non-parallel with the barrel, rather than pivoting, and a driver portion of the door would be coupled to the cam or to the linear actuator, with motion of the driver portion of the door causing the cover portion of the door to move. A spring could be provided on the cover portion of the door to keep the cover portion of the door biased toward a closed position except when acted upon by the driver portion of the door.

Figure 32:
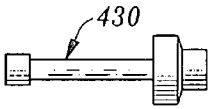
FIG. 32 is a perspective view of an alternative pin valve.
Figure 33:
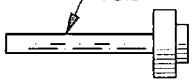
FIG. 33 is a perspective view of an alternative pin valve.

Additionally, FIGS. 32 and 33 show alternate pin valve embodiments 430 and 432, respectively of the pin valve 248 shown in FIG. 10.

Furthermore, an embodiment of the invention can be embodied into four basic configurations of paintball markers: electro pneumatic, pneumatic, blowback and single action or stock class.

In a first example, an embodiment of the present invention can be comprised of an electro pneumatic marker, at rest the marker is in the open position, the firing chamber being open and a paintball able drop as delineated above. Trigger is provided for firing the marker; said trigger is connected to an electric switch or a sensor such as a magnetic field sensor, potentiometer, or other resistance-measuring device. Said switch or sensor itself controlling a solenoid. Said solenoid controls a ram and a hammer mated to it. Said hammer includes slideability (note: slideability within a blind bore is removed) within the housing of the marker. Activating said solenoid causes said ram to extend. Extension of said ram and, thereby movement of hammer coupled to it, said hammer having a rod extending from it, said hammer rod in turn acts upon the door rotating it on its' axis and closing said door. Said door, having said "L" extending from it, upon closing occupies some of the space of the loading chamber, said "L" occupying some of said loading chamber paintball is forced at least partially into barrel. Further extension of said ram causes contact between said hammer with a valve seat and valve pin configuration, said contact causing compressed gas to be released from the top of said valve. Said compressed gas flows past back plug and fires a paintball. Electric sensor is timed in such a manor that release of said compressed gas through solenoid is reversed causing the ram to contract, which in turn causes the hammer and thereby the hammer rod to return to their original positions, which in turn causes the door to rotate on axis and again return to its' open position. Operator could now toggle the trigger and complete the cycle again.

In a second example, an embodiment of the present invention can be comprised of a pneumatic marker, having a trigger is provided for firing the marker. This trigger is coupled to a sear. The sear controls a hammer. The hammer includes slideability within a blind bore within the housing of the marker. Hammer being biased in the forward or firing position by a spring. Toggling of said trigger causes sear to release said hammer allowing for rearward movement of the hammer. Said hammer, having a rod extending from it, hammer rod in turn acts upon the door pivoting it on its' axis and closing the door. Said door, having said "L" extending from it, upon closing occupies some of the space of the loading chamber, said "L" occupying some of said loading chamber paintball is forced at least partially into barrel. Further movement of said hammer causes said hammer to contact with a valve seat and valve pin configuration, said contact causing compressed gas to flow through the valve past said back plug allowing the firing of the paintball. Increased toggling activates a 3-way pneumatic valve. Said valve controls the position of a ram. Said ram acting upon said hammer so that extension of said rams returns said hammer to the cocked position where said sear again captures said hammer. Said ram having a rod extending from it, would in turn act upon the door pivoting it on its' axis and opening the loading chamber allowing for loading of the next paintball. Release of trigger would allow for return of 3-way valve, which would in turn retract said ram, which would in turn close said door, resealing the firing chamber, with said door at least partially occupying loading chamber and in turn transitioning the paintball at least partially into the barrel. Operator could now toggle the trigger and complete the cycle again.

In a second example, an embodiment of the present invention can be comprised of a blow back marker, a trigger is provided for firing the marker. This trigger is coupled to a sear. The sear controls a hammer. The hammer includes slideability within a blind bore within the housing of the marker. Hammer being biased in the rearward or firing position by a spring. Marker being in the open and cocked position, the firing chamber is open and a paintball can drop in, the spring being in the compress state. Toggling of said trigger causes release of said hammer, movement of the hammer caused by release of stored energy in compressed spring. Said hammer, having a connecting rod extending from it, connecting rod in turn acts upon the door pivoting it on its' axis and closing the door. Said door, having said "L" extending from it, upon closing occupies some of the space of the loading chamber, said "L" occupying some of said loading chamber the paintball is forced at least partially into barrel. Further movement of hammer causes hammer to contact with a valve seat and valve pin configuration, said contact causing compressed gas to be released from the top and the front of said valve seat. Upon the release of said compressed gas through top of said valve said compressed gas flows past the back plug in turn firing said paintball. Further release of said compressed gas through front of said valve in turn causes return of said hammer to its original position, movement of said hammer and said hammer rod coupled to it causes reopening of said door, again allowing a paintball into the loading chamber. Operator could now toggle the trigger and complete the cycle again.

In a fourth example, an embodiment of the present invention can be comprised of a stock class marker; a trigger is provided for firing the marker. This trigger is coupled to a sear. The sear controls a hammer. The hammer includes slideability within a blind bore within the housing of the marker. Hammer being biased in the forward or firing position by a spring. Toggling of said trigger causes sear to release said hammer allowing for rearward movement of the hammer. Said hammer, having a rod extending from it, hammer rod in turn acts upon the door pivoting it on its' axis and closing the door. Said door, having said "L" extending from it, upon closing occupies some of the space of the loading chamber, said "L" occupying some of said loading chamber paintball is forced at least partially into barrel. Further movement of said hammer causes said hammer to contact with a valve seat and valve pin configuration, said contact causing compressed gas to flow through the valve past said back plug allowing the firing of the paintball. After firing the operator would then cock the marker. Said cocking would consist of pumping an actuator grip mounted on the front of the marker. The first half of the cocking stroke would reset the hammer allowing the sear to capture it and, via a rod extending from said actuator grip, would act upon the door causing it to pivot on its' axis. Said pivoting would expose the loading chamber allowing for loading of the next paintball. The second half, or return stoke of cocking procedure, would cause the door to close, said door closing resealing the firing chamber, with said door at least partially occupying loading chamber thereby causing transitioning of the paintball at least partially into the barrel. Operator could now complete the cycle again.

Accordingly, and in one aspect, the present invention provides a paintball marker 10 that is significantly reduced in length.

In another aspect, the present invention provides the paintball marker 10 that can be quickly and easily cleaned, especially through the loading and firing chamber and continuing through the barrel.

In another aspect, the present invention provides the paintball marker 10 which is of a lightweight and relatively simple design.

In another aspect, the present invention provides the paintball marker 10 which can rapidly fire paintballs.

In another aspect, the present invention provides the paintball marker 10 which accurately fires a paintball with a charge of compressed gas.

In another aspect, the present invention provides the paintball marker 10 which reliably loads paintballs, and avoids jamming and paintball rupture.

In another aspect, the present invention provides the paintball marker 10 which has a unique appearance and can be easily distinguished from other paintball markers.

These aspects, along with the above delineation of the paintball marker 10 including its use and operation, demonstrate the industrial applicability of this invention.

This disclosure is provided to reveal a preferred embodiment of the invention and a best mode for practicing the invention. Having thus described the invention in this way, it should be apparent that various different modifications can be made to the preferred embodiment without departing from the scope and spirit of this invention disclosure. When structures are identified as a means to perform a function, the identification is intended to include all structures which can perform the function specified. When structures of this invention are identified as being coupled together, such language should be interpreted broadly to include the structures being coupled directly together or coupled together through intervening structures. Such coupling could be permanent or temporary and either in a rigid fashion or in a fashion which allows pivoting, sliding or other relative motion while still providing some form of attachment, unless specifically restricted.

What is claimed is:

1. A pneumatic paintball marker, comprising in combination:

a housing including an hollow open ended firing chamber having a first open end operatively coupled to a barrel and a second open end closed by a removable back plug;

said firing chamber having a paintball-loading hole in a side wall thereof at a location between said back plug and said barrel;

a door surmounting said firing chamber and slidingly coupled to said housing for providing access to said paintball-loading hole when the door is pivoted to an open position and for sealing said firing chamber when said door is pivoted to a closed position;

a means for camming, said means for camming operatively coupled to said door;

a means for controlling door position, including a linear actuator operatively coupled to said means for camming such that said cam means transforms a linear motion of said linear actuator into a sliding motion of said door for sliding said door from the open to closed position and from the closed to open position;

a pin valve interposed between a source of compressed gas and a bore leading to said firing chamber and located behind said linear actuator for controlling a gas path between said source of compressed gas and said firing chamber;

a selectively openable gas path between said source of compressed gas and said linear actuator of said means for controlling door position, and a trigger operatively coupled to said means for controlling door position, said trigger adapted to open the selectively openable gas path between said source of compressed gas and said linear actuator for moving said linear actuator from a forward to a backward position such that said means for camming transforms linear motion of said linear actuator into sliding motion of said door for sliding said door from the open position such that a paintball is loaded into the firing chamber to a closed position for sealing the firing chamber and then continuing to move said linear actuator backward to a position of impact with said pin valve for opening the gas path between said source of compressed gas and said firing chamber for firing the paintball through and out said barrel in an opposite direction of movement of said linear actuator when said trigger is actuated.

2. The combination of claim 1, wherein said door is pivotally coupled to said housing.

3. The combination of claim 1, wherein said door is adapted to slide linearly relative to said housing, along a path non-parallel with said barrel.

4. The combination of claim 3, wherein said door includes a beveled end abutting a beveled end of a driver, said driver operatively coupled to said means for camming and adapted to slide said door.

5. The combination of claim 2, further including means operatively coupled to said door for urging the paintball at least partially into said barrel when said door is pivoted closed.

6. The combination of claim 5, wherein said door is controlled by said means for controlling door position so that said door is restricted to said closed position when said pin valve is open for opening the gas path between said source of compressed gas and said firing chamber for firing the paintball through and out said barrel in said opposite direction of movement of said linear actuator when said trigger is actuated.

7. The combination of claim 6, wherein said door surmounting said firing chamber and pivotally coupled to said housing for providing access to said paintball-loading hole when said door is pivoted to said open position and for sealing said firing chamber when said door is pivoted to said closed position rides within a stepped groove disposed within said housing for restricting said door to rotating between said open and said closed position.

8. The combination of claim 7, wherein said door is pivotally coupled to said housing about an axis offset from line of firing chamber and barrel.

9. The combination of claim 8, wherein said means for camming operatively coupled to said door includes a cam slot cut into said door.

10. The combination of claim 9, wherein said linear actuator is housed within an actuator housing mounted underneath said firing chamber and barrel and wherein said linear actuator is comprised of an elongated member comprised of a ram riding in a bore of a housing at one end and a hammer operatively coupled to an opposing end at a location in alignment for impacting said pin of said pin valve for opening said pin valve when said linear actuator is moved backward to said position of impact with said pin of said pin valve.

11. The combination of claim 10, wherein said means for controlling door position further includes a manifold mated to a solenoid and operatively coupled to said bore of said housing for directing compressed gas into a forward compartment of said bore for coacting with said ram and holding said ram in an open position and upon trigger activation said solenoid directing compressed gas through the manifold and to a rearward portion of said bore for coacting with said ram for moving said linear actuator from a forward to a backward position such that said means for camming transforms linear motion of said linear actuator into rotational motion of said door for pivoting said door from the open position such that the paintball is loaded into the firing chamber to said closed position for sealing the firing chamber and blocking passage of paintballs therein and then continuing to move said linear actuator backward to said position of impact of said hammer with said pin of said pin valve for opening the gas path between said source of compressed gas and said firing chamber for firing the paintball through and out said barrel in an opposite direction of movement of said linear actuator when said trigger is actuated.

12. The combination of claim 11, wherein said linear actuator further includes a ram operatively coupled to a hammer for impacting a pin of said pin valve for opening said pin valve when said linear actuator is moved backward to said position of impact with said pin of said pin valve for opening the gas path between said source of compressed gas and said firing chamber for firing the paintball through and out said barrel in an opposite direction of movement of said linear actuator when said trigger is actuated.

13. A pneumatic paintball marker, comprising in combination:

a housing including an hollow open ended firing chamber extending therethrough and comprised of a first open end, a second open end, and a paintball loading hole disposed in a sidewall thereof at a location between said first open end and said second open end of said firing chamber;

a barrel comprised of an entrance end and an exit end and shaped for receiving and passing a paintball therethrough, said entrance end being operatively coupled to said first open end of said firing chamber;

a removable back plug operatively coupled to said second open end of said firing chamber opposite said first open end for sealing said second open end of said firing chamber during use, said removable back plug removed from said second open end of said firing chamber for allowing cleaning access through said barrel and firing chamber;

a door surmounting said firing chamber and pivotally coupled to said housing for providing access to said paintball-loading hole when the door is pivoted to an open position and sealing said firing chamber when said door is pivoted to a closed position;

a means for camming operatively coupled to said door;

a means for controlling position of said door including a linear actuator operatively coupled to said means for camming such that said cam means transforms a linear motion of said linear actuator into a rotational motion of said door for pivoting said door from the opened to closed position and from the closed to opened position under direction of said means for controlling position of said door;

a valve operatively coupled to said means for controlling position of said door and interposed between a source of compressed gas and a bore leading to said firing chamber for controlling a gas path therebetween under the control of said means for controlling position of said door;

a trigger operatively coupled to said means for controlling position of said door wherein when said trigger is actuated said means for controlling position of said door pivots said door from the open position such that a paintball is loaded into the firing chamber to a closed position for sealing the firing chamber and then subsequently opens said valve for opening the gas path between said source of compressed gas and said firing chamber for firing the paintball through and out said barrel of said pneumatic paintball marker.

14. The combination of claim 13, wherein said valve is a pin valve interposed between said source of compressed gas and said bore leading to said firing chamber for controlling said gas path therebetween.

15. The combination of claim 14, wherein when said trigger is actuated, said linear actuator moves from a forward to a backward position for pivoting said door from the open position to the closed position and continues to move backward for coacting with said pin valve for opening the gas path between said source of compressed gas and said firing chamber for firing the paintball through and out said barrel in a direction opposing the direction of said linear actuator upon trigger actuation.

16. The combination of claim 15, wherein when said trigger is actuated, said linear actuator moves from the forward to the backward position for pivoting said door from the open position to the closed position and continues to move backward for coacting with said pin valve for opening the gas path between said source of compressed gas and said firing chamber for firing the paintball through and out said barrel in a direction opposing the direction of said linear actuator upon trigger actuation.

17. The combination of claim 16, wherein said means for camming includes an extended cam groove integrally formed within said door.

18. The combination of claim 17, wherein said linear actuator includes an elongated connecting rod terminating at one end to a rotatable cap.

19. The combination of claim 18, wherein said connecting rod of said linear actuator is operatively coupled to said means for camming by said rotatable cap being received within said cam groove integrally formed within said door.

20. The combination of claim 19, wherein said linear actuator includes a reciprocating hammer operatively coupled to said connecting rod for providing linear motion of said connecting rod wherein when said trigger is actuated, said hammer moves said connecting from a forward to a backward position such that said means for camming transforms a linear motion of said connecting rod into a rotational motion of said door for pivoting said door from the open position to the closed position and wherein when said trigger is actuated said hammer continues to move backward for impacting with said pin valve for opening the gas path between said source of compressed gas and said firing chamber for firing the paintball through and out said barrel in a direction opposing the direction of motion of said hammer and connecting rod.

21. A pneumatic paintball marker, comprising in combination:

a housing including an hollow open ended firing chamber extending therethrough and comprised of a first open end, a second open end, and a paintball loading hole disposed in a sidewall thereof;

a barrel operatively coupled to said first open end;

a removable back plug operatively coupled to said second open end, a door pivotally coupled to said housing and surmounting said firing chamber loading hole disposed in said sidewall between said back plug and said barrel;

a door cam operatively coupled to said door;

an actuator coupled to said door cam;

a valve operatively coupled to said actuator and interposed in a first gas path between a source of compressed gas and a passage leading to said firing chamber, and a trigger operatively coupled to a second gas path between the source of compressed gas and said actuator, said trigger adapted to open said second gas path to move said actuator, said door cam adapted to transform motion of said actuator into pivoting motion of said door from an open position in which a paintball is loaded into said firing chamber to a closed position and then continues to move said actuator to coact with said valve for opening said first gas path for firing the paintball.

22. The combination of claim 21, wherein said actuator is a linear actuator and wherein said door cam transforms a linear motion of said linear actuator into a rotational motion of said door for pivoting said door from the open position such that that paintball is loaded into the firing chamber to the closed position.

23. The combination of claim 22, wherein said door cam is comprised of an integrally formed groove within said door receiving a rotatable end of a connecting rod of said actuator for transforming linear motion of said linear actuator into rotational motion of said door.

* * * * *